US010405665B2

(12) United States Patent
Long

(10) Patent No.: US 10,405,665 B2
(45) **Date of Patent: *Sep. 10, 2019**

(54) POCKETED SPRING COMFORT LAYER AND METHOD OF MAKING SAME

(71) Applicant: L&P Property Management Company, South Gate, CA (US)

(72) Inventor: Austin G. Long, Sarcoxie, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/628,128

(22) Filed: Jun. 20, 2017

(65) Prior Publication Data

US 2017/0283245 A1 Oct. 5, 2017

Related U.S. Application Data

(63) Continuation-in-part of application No. 15/062,318, filed on Mar. 7, 2016, now Pat. No. 9,968,202, which is a continuation-in-part of application No. 14/879,672, filed on Oct. 9, 2015, now Pat. No. 9,943,173.

(Continued)

(51) Int. Cl.

| | |
|---|---|
| ***A47C 7/34*** | (2006.01) |
| ***A47G 9/00*** | (2006.01) |
| ***A47C 21/04*** | (2006.01) |
| ***A47C 27/06*** | (2006.01) |
| ***B68G 9/00*** | (2006.01) |

(52) U.S. Cl.

CPC ..... *A47C 7/34* (2013.01); *A47C 21/046* (2013.01); *A47C 27/06* (2013.01); *A47C 27/064* (2013.01); *A47G 9/00* (2013.01); *B68G 9/00* (2013.01)

(58) Field of Classification Search

CPC ..... A47C 7/34; A47C 21/046; A47C 27/06; A47C 27/064; A47G 9/00; B68G 9/00

See application file for complete search history.

(56) References Cited

U.S. PATENT DOCUMENTS 4,234,983 A * 11/1980 Stumpf ..... A47C 27/064 5/246
4,451,946 A * 6/1984 Stumpf ..... A47C 27/064 5/655.8

(Continued)

FOREIGN PATENT DOCUMENTS

EP 1067090 1/2001
EP 1707081 4/2008

(Continued)

*Primary Examiner* — Nicholas F Polito
*Assistant Examiner* — Rahib T Zaman
(74) *Attorney, Agent, or Firm* — Wood, Herron & Evans, LLP

(57) ABSTRACT

A comfort layer for a bedding or seating product has slow-acting pockets characterized by the individual springs of the comfort layer being pocketed with either semi-impermeable or impermeable fabric. Each seam joining opposed plies of fabric around each of the coil springs of the comfort layer may be segmented, allowing air to flow between the segments, thereby increasing the luxury "feel" of the comfort layer. The method of making the comfort layer includes compressing the springs and creating pockets with a welding horn and an anvil.

10 Claims, 22 Drawing Sheets

Related U.S. Application Data

(60) Provisional application No. 62/115,785, filed on Feb. 13, 2015.

(56) References Cited

U.S. PATENT DOCUMENTS 4,485,506 A * 12/1984 Stumpf ..... A47C 27/064 267/83
4,573,741 A * 3/1986 Kirchner-Carl ..... A47C 7/18 267/81
4,574,099 A 3/1986 Nixon
4,594,278 A 6/1986 Nixon
5,105,488 A * 4/1992 Hutchinson ..... A47C 23/047 5/614
5,438,718 A 8/1995 Kelly et al.
6,154,908 A * 12/2000 Wells ..... A47C 27/066 5/720
6,319,864 B1 11/2001 Hannigan et al.
6,447,874 B2 * 9/2002 Antinori ..... B32B 5/22 112/420
6,537,930 B1 3/2003 Middlesworth et al.
6,591,438 B1 * 7/2003 Edling ..... A47C 27/064 5/655.8
6,598,251 B2 * 7/2003 Habboub ..... B60N 2/242 297/452.42
6,602,809 B1 8/2003 Cabrey
6,706,225 B2 3/2004 Cabrey
6,826,796 B1 * 12/2004 Mossbeck ..... A47C 23/0433 5/655.8
7,410,030 B2 8/2008 Fusiki et al.
7,622,406 B2 11/2009 Holland et al.
7,636,972 B2 * 12/2009 Mossbeck ..... A47C 27/053 5/716
7,788,952 B2 9/2010 Morrison
7,820,570 B2 10/2010 Holland et al.
7,828,029 B2 11/2010 Holland et al.
7,877,964 B2 2/2011 Spinks et al.
8,011,046 B2 9/2011 Stjerna
8,087,114 B2 * 1/2012 Lundevall ..... A47C 27/063 267/166
8,136,187 B2 3/2012 Mossbeck et al.
8,157,051 B2 4/2012 Marcel et al.
8,322,487 B1 12/2012 Kitchen et al.
8,464,830 B2 6/2013 Ishikawa et al.
8,474,078 B2 * 7/2013 Mossbeck ..... A47C 27/053 5/716
8,574,700 B2 11/2013 Hattori
8,695,757 B2 4/2014 Duval et al.
9,133,615 B2 9/2015 Bischoff et al.
2002/0025747 A1 2/2002 Rock et al.
2003/0009831 A1 * 1/2003 Giori ..... A47C 27/084 5/709
2003/0104735 A1 6/2003 Rock et al.
2004/0010853 A1 * 1/2004 Muci ..... A47C 27/081 5/644
2004/0133988 A1 7/2004 Barber
2005/0273938 A1 * 12/2005 Metzger ..... A47C 27/081 5/712
2007/0044243 A1 * 3/2007 Metzger ..... A47C 27/081 5/712
2007/0137926 A1 6/2007 Albin, Jr. et al.
2007/0261548 A1 11/2007 Vrzalik et al.
2007/0289069 A1 * 12/2007 Wells ..... A47C 27/056 5/727
2009/0211028 A1 * 8/2009 Richmond ..... A47C 20/041 5/618
2009/0222985 A1 * 9/2009 Richmond ..... A47C 27/053 5/247
2009/0298374 A1 12/2009 Delmas
2010/0212090 A1 * 8/2010 Stjerna ..... A47C 27/064 5/720
2010/0255270 A1 10/2010 Stuebiger
2011/0014406 A1 1/2011 Coleman et al.
2011/0113551 A1 * 5/2011 Lin ..... A47C 21/048 5/417
2011/0314613 A1 * 12/2011 Haffner ..... A47C 23/007 5/720
2012/0167303 A1 7/2012 Stroh et al.
2013/0029550 A1 1/2013 Seth et al.
2013/0174350 A1 7/2013 Allman et al.
2013/0198941 A1 8/2013 John et al.
2014/0287643 A1 9/2014 Nozaki et al.
2014/0373282 A1 * 12/2014 Mossbeck ..... A47C 27/064 5/720
2015/0026893 A1 * 1/2015 Garrett ..... A47C 27/064 5/691
2015/0284901 A1 10/2015 Blackwell, Jr. et al.
2015/0359349 A1 * 12/2015 Eigenmann ..... A47C 27/064 5/655.8
2016/0235212 A1 8/2016 Krtek et al.
2017/0251820 A1 9/2017 Long

FOREIGN PATENT DOCUMENTS

EP 2789267 10/2014
GB 167025 2/1921
KR 200462261 9/2012
WO 2014023975 2/2014

* cited by examiner

POCKETED SPRING COMFORT LAYER AND METHOD OF MAKING SAME

CROSS REFERENCE TO RELATED APPLICATIONS

This application is a continuation-in-part of U.S. patent application Ser. No. 15/062,318 filed Mar. 7, 2016, now U.S. Pat. No. 9,968,202, a continuation-in-part of U.S. patent application Ser. No. 14/879,672 filed Oct. 9, 2015, now U.S. Pat. No. 9,943,173, which claims the benefit of U.S. Provisional Patent Application Ser. No. 62/115,785 filed Feb. 13, 2015, each application of which is fully incorporated by reference herein.

TECHNICAL FIELD OF THE INVENTION

This invention relates to a comfort layer for bedding and seating products. More particularly, this invention relates to a pocketed spring comfort layer for use in seating or bedding products and the method of manufacturing such comfort layer.

BACKGROUND OF THE INVENTION

Comfort layers are commonly used in seating or bedding products above/below a core, which may or may not include a spring assembly. Such comfort layers may include foam, fiber and gel products. U.S. Pat. No. 8,087,114 discloses a comfort layer made of pocketed springs. Such spring assemblies may be made of strings of individually pocketed coil springs joined or multiple coil springs joined by helical lacing wires.

Spring cores may be generally covered on the top and often on the bottom by pads of resilient foam as, for example, a pad of urethane or latex/urethane mix of foamed material. Within the last several years, more expensive cushions or mattresses have had the spring cores covered by a visco-elastic foam pad, which is slow acting or latex foam, which is faster acting than visco-elastic foam. That is, the visco-elastic foam pad is slow to compress under load and slow to recover to its original height when the load is removed from the visco-elastic foam pad. These visco-elastic pads, as well as the latex pads, impart a so-called luxury feel to the mattress or cushion. These pads also, because of their closed cell structure, retain heat and are slow to dissipate body heat when a person sits or lies atop such a foam pad-containing cushion or mattress.

Individually pocketed spring cores have been made with fabric material semi-impermeable to airflow through the fabric material, as more fully explained below. U.S. Pat. No. 7,636,972 discloses such a pocketed spring core.

European Patent No. EP 1707081 discloses a pocketed spring mattress in which each pocket has a ventilation hole in order to improve the airflow into and out of the pocket. However, one drawback to such a product, depending upon the fabric used in the product, is that the fabric of the pocket may create "noise", as the sound is named in the industry. Such noise may be created by the fabric expanding upon removal of the load due to the coil spring's upwardly directed force on the fabric.

It is therefore an objective of this invention to provide a comfort layer for a seating or bedding product, which has the same luxury feel as a visco-elastic or latex pad-containing comfort layer, but without the heat retention characteristics of such a comfort layer.

Still another objective of this invention is to provide one or more comfort layers for a seating or bedding product having the same or a similar slow-to-compress and slow-to-recover to its original height luxury feel as memory foam.

Another objective of this invention is to provide a comfort layer for a seating or bedding product made, at least partially, with fabric impervious to airflow through the fabric, but which allows air to enter and exit the pockets at different flow rates in reaction to different loads being applied to one or more pockets.

Another objective of this invention is to provide a comfort layer for a seating or bedding product made, at least partially, with fabric impervious to airflow through the fabric, but which allows air to enter and exit the pockets via gaps in the seams of at least some of the pockets.

SUMMARY OF THE INVENTION

The invention, which accomplishes these objectives, comprises a comfort layer for a seating or bedding product. The comfort layer comprises an assembly or matrix of individually pocketed springs, each spring being contained within a fabric pocket. The fabric pocketing material within which the springs are contained may be semi-impermeable to airflow through the fabric material. As used herein, the term "semi-impermeable" means that the fabric material, while permitting some airflow through the material, does so at a rate which retards or slows the rate at which a spring maintained in a pocket of the fabric may compress under load or return to its original height when a load is removed from the pocketed spring. In other words, air may pass through such a semi-impermeable material, but at a reduced rate compared to the rate at which air usually flows through a non-woven polypropylene material commonly used in the bedding industry.

Alternatively, the fabric material within which the springs are contained may be non-permeable or impermeable to airflow through the fabric material. In other words, air may not flow through the fabric material.

When a load is applied to a comfort layer made with semi-impermeable fabric, the rate of deflection of the comfort layer is retarded by the rate at which air escapes through the semi-impermeable fabric within which the pocketed springs are contained and by the rate at which air travels between segments of weld seams separating individual pockets.

When a load is applied to the comfort layer made with impermeable fabric, the rate of deflection of the comfort layer is retarded only by the rate at which air escapes or travels between segments of weld seams separating individual pockets. Regardless of the type of fabric used to make the comfort layer, the seam segments may be any desired shape, including curved or straight, and any desired length to control airflow within the comfort layer. The length, size and/or shape of the seam segments may be manufactured to achieve a desired airflow between the interior of the pocket and the space outside the pocket.

Any of the embodiments of comfort layer shown or described herein may be incorporated into a bedding product, such as a mattress, bedding foundation or pillow. Further, any of the embodiments of comfort layer shown or described herein may be incorporated into a seating product, such as a vehicle seat and/or office or residential furniture, such as a recliner.

Alternatively, any of the embodiments of comfort layer shown or described herein may be sold independently as a retail or wholesale item. In such an application, the comfort layer may be added to and/or removed from a bedding or seating product by a customer.

The comfort layer of the present invention, whether incorporated inside a bedding or seating product, or manufactured and sold as a separate product, provides an additional cooling effect to the product due to airflow through the comfort layer, including between adjacent pockets. The amount of airflow between pockets may be changed by changing the size of the teeth or slots on a welding tool, including an ultrasonic welding tool. This is an easy way to adjust airflow inside a comfort layer and out of the comfort layer without changing the fabric material of the comfort layer.

Another advantage of this invention is that the comfort layer allows air to flow between pockets inside a pocketed spring comfort layer and either exit or enter the comfort layer along the periphery or edge of the comfort layer, such airflow contributing to the luxurious "feel" of any bedding or seating product incorporating the comfort layer. The comfort layer of the present invention has the slow-acting compression and height recovery characteristics of heretofore expensive visco-elastic foam comfort layers, but without the undesirable heat retention characteristics of such foam comfort layers.

According to another aspect of the present invention, a method of manufacturing a comfort layer for a bedding or seating product is provided. The comfort layer is characterized by slow and gentle compression when a load is applied to the product. The method comprises forming a continuous blanket of individually pocketed springs, each spring being contained within a pocket of fabric formed by joining multiple plies of fabric with weld seams. The fabric is impermeable to airflow through the fabric. The opposed plies of fabric are joined along segments with gaps between adjacent segments of the weld seams.

The continuous blanket of individually pocketed springs is cut to a desired size after passing through a machine. The machine inserts multiple springs between two plies of fabric and joins the fabric plies along weld seams around the perimeter of each of the springs.

The comfort layer is characterized, when a load is applied to the comfort layer, by the rate of deflection of the comfort layer being retarded by the rate at which air passes through the gaps of the weld seams, the gaps widening or changing in size or shape or both upon being subject to a load, allowing air to exit the pockets of the comfort layer at a desired rate.

The comfort layer is further characterized by the rate of recovery of the comfort layer to its original height after removal of a load from the comfort layer being retarded by the rate at which air returns between the segments of the weld seams into the pockets. The gaps decrease in width upon the load being removed, allowing air to enter the pockets of the comfort layer at a desired rate. The rate at which air travels between individual pockets is determined by the size of gaps between the segments of weld seams separating adjacent pockets. Around the perimeter of the comfort layer, air enters and exits the interior of the comfort layer through gaps between the segments of the perimeter weld seams of the comfort layer. By constructing a comfort layer with gaps of a predetermined size, the airflow into and out of the comfort layer may be controlled. The airflow into and out of the comfort layer may be further dependent upon the type of fabric used to construct the comfort layer.

The method of manufacturing a comfort layer for a bedding or seating product may comprise the following steps. The first step comprises forming a continuous blanket of individually pocketed springs, each of the springs being surrounded by a segmented weld seam which allows airflow through the weld seam. The continuous blanket of individually pocketed springs may be later cut to a desired size. Each spring is contained within a pocket having a weld seam comprising multiple segments. The fabric is impermeable to airflow through the fabric. However, air may flow through the pockets due to gaps between the segments of the weld seams forming the pockets. The comfort layer is characterized by slow and gentle compression when a load is applied to the comfort layer. When a load is placed upon the comfort layer and then removed, the rate of return of the comfort layer to its original height is retarded by the rate at which air returns through the semi-impermeable pockets within which the springs are contained. At least some of the gaps of the weld seams surrounding a pocket increase in width, i.e., size or shape when a load is applied to the pocket, allowing air to exit the affected pockets of the comforts at a controlled rate. For example, when a heavy person sits on a product having such a comfort layer, the sudden increase in load quickly opens the gaps of the weld seams and allows air to quickly and efficiently exit the affected pockets of the comfort layer. This prevents any damage to the comfort layer and provides a luxury feel to the user, regardless of the load applied.

The comfort layer is further characterized, when a load is removed from the comfort layer, by the gaps decreasing in width to control air flow rate into the affected pockets of the comfort layer.

The fabric from which the pockets are made may be wholly or partially made of fabric, non-permeable or impermeable to airflow. In such a situation, the air entering and exiting the pockets is limited by the air which flows through gaps between segments of weld seams surrounding the springs.

The fabric from which the pockets are made may be wholly or partially made of fabric semi-impermeable to airflow. In such a situation, the air entering and exiting the pockets is limited by the air, not only which flows through gaps between segments of weld seams surrounding the springs, but also by air which flows through the fabric. Regardless of which fabric is used to make the plies, by controlling the airflow into and out of the individual pockets, the rate of recovery of the comfort layer, when a load is removed, may be different than the rate of entry of air into the pockets when a load is applied.

By restricting airflow through the weld seams of a pocketed spring comfort layer, a manufacturer of the comfort layer may create a comfort layer with a luxury feel without using any foam in a cost-effective manner.

These and other objects and advantages of this invention will be readily apparent from the following drawings, in which:

DETAILED DESCRIPTION OF THE DRAWINGS

Figure 1:
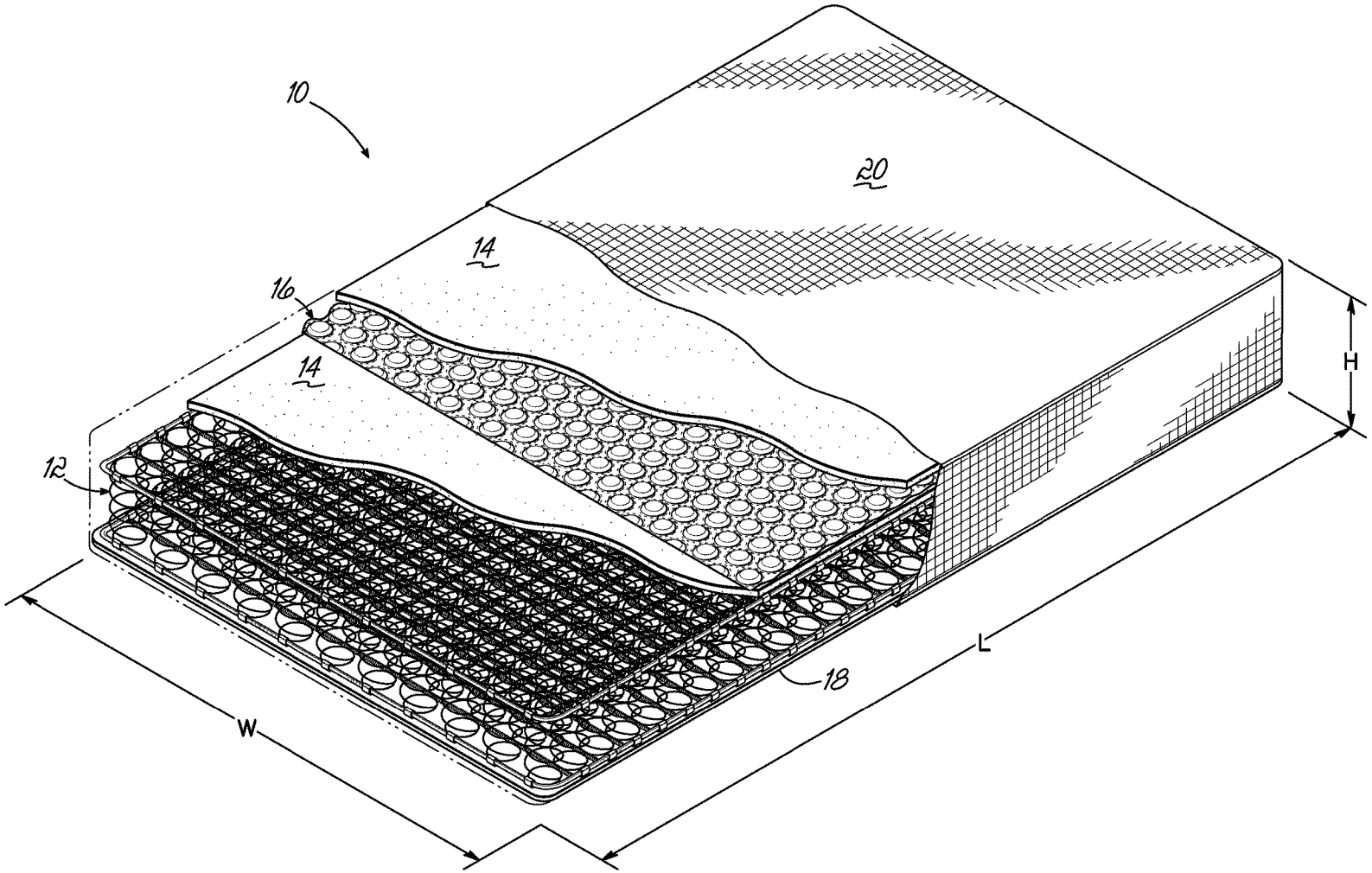
FIG. 1 is a perspective view, partially broken away, of a bedding product incorporating one of the comfort layers of this invention.

FIG. 1 illustrates a single-sided mattress 10 incorporating one embodiment of comfort layer in accordance with this invention. This mattress 10 comprises a spring core 12 over the top of which there is a conventional cushioning pad 14 which may be partially or entirely made of foam or fiber or gel, etc. The cushioning pad 14 may be covered by a comfort layer 16 constructed in accordance with the present invention. A second conventional cushioning pad 14 may be located above the comfort layer 16. In some applications, one or more of the cushioning pads 14 may be omitted. This complete assembly may be mounted upon a base 18 and is completely enclosed within a cover 20, such as an upholstered cover for example.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of comfort layer are illustrated and described as being embodied in a single-sided mattress, any of the comfort layers shown or described herein may be used in a single-sided mattress, double-sided mattress or seating cushion. In the event that any such comfort layer is utilized in connection with a double-sided product, then the bottom side of the product's core may have a comfort layer applied over the bottom side of the core and either comfort layer may be covered by one or more cushioning pads made of any conventional material. According to the practice of this invention, though, either the cushioning pad or pads, on top and/or bottom of the core, may be omitted. The novel features of the present invention reside in the comfort layer and/or the product's pocketed core.

Although spring core 12 is illustrated being made of unpocketed coil springs held together with helical lacing wires, the core of any of the products, such as mattresses shown or described herein, may be made wholly or partially of pocketed coil springs (see FIGS. 7 and 14), one or more foam pieces (not shown) or any combination thereof. Any of the comfort layers described or shown herein may be used in any single or double-sided bedding or seating product having any conventional core. The core may be any conventional core including, but not limited to, pocketed or conventional spring cores.

Figure 4:
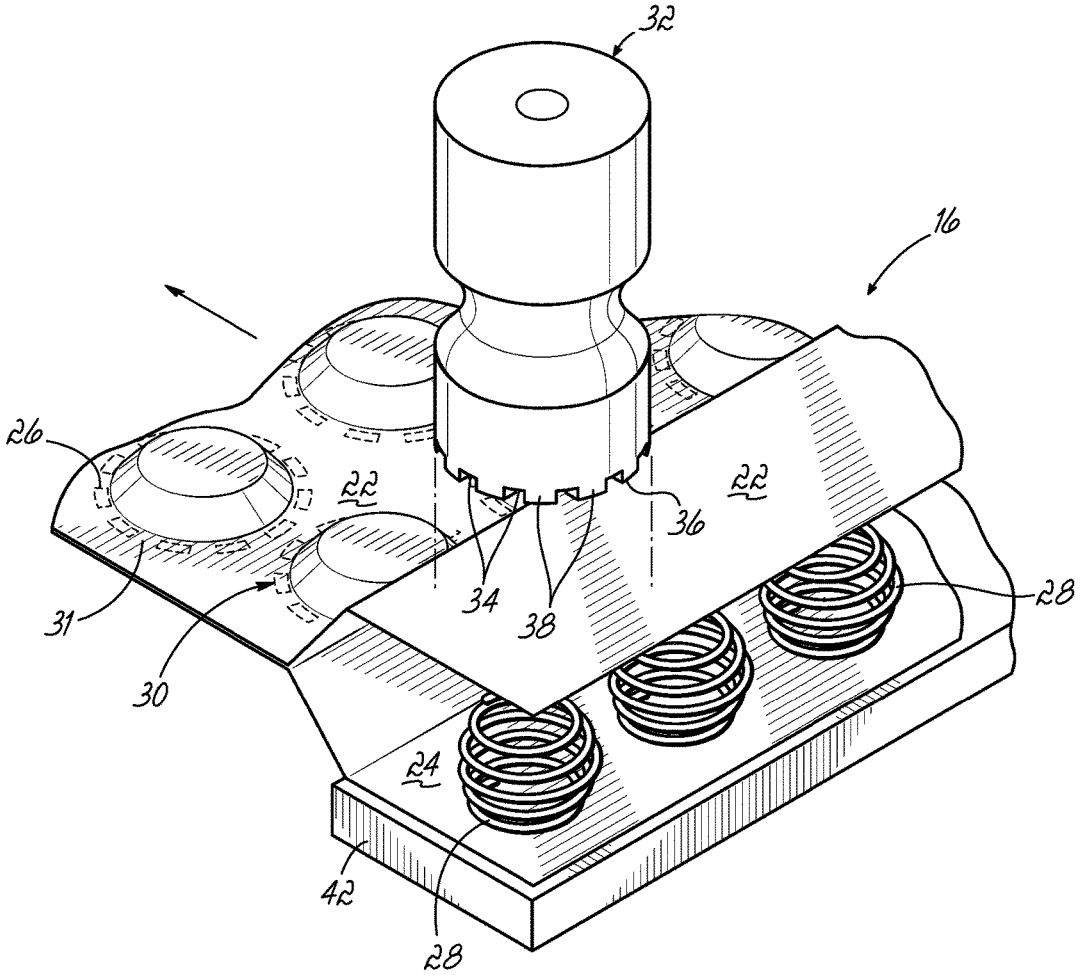
FIG. 4 is an enlarged perspective view of a portion of the comfort layer of FIG. 1 partially disassembled and showing a portion of a welding tool.

FIG. 4 illustrates the components of one embodiment of comfort layer 16 incorporated into the mattress 10 shown in FIG. 1. The comfort layer 16 comprises a first or upper ply of fabric 22 and a second or lower ply of fabric 24 with a plurality of mini coil springs 28 therebetween. The fabric plies 22, 24 are joined with circular containments or weld seams 30, each weld seam 30 surrounding a mini coil spring 28. Each circular weld seam 30 comprises multiple arced or curved segments 26 with gaps 31 therebetween. The first and second plies of fabric 22, 24 are joined along each arced or curved segment 26 of each circular weld seam 30. The first and second plies of fabric 22, 24 are not joined along each gap 31 between adjacent segments 26 of each circular weld seam 30. The curved segments 26 are strategically placed around a mini coil spring 28 and create the circular weld seam 30. The two plies of fabric 22, 24, in combination with one of the circular weld seams 30, define a cylindrical-shaped pocket 44, inside of which is at least one resilient member such as a mini coil spring 28. See FIGS. 5 and 5A.

During the welding process, the mini coil springs 28 may be at least partially compressed before pocket 44 is closed and thereafter. If desired, resilient members other than mini coil springs, such as foam or plastic or gel or a combination thereof, may be used. Each of the resilient members may return to its original configuration after a load is removed from the pockets in which the resilient members are located.

Figure 5:
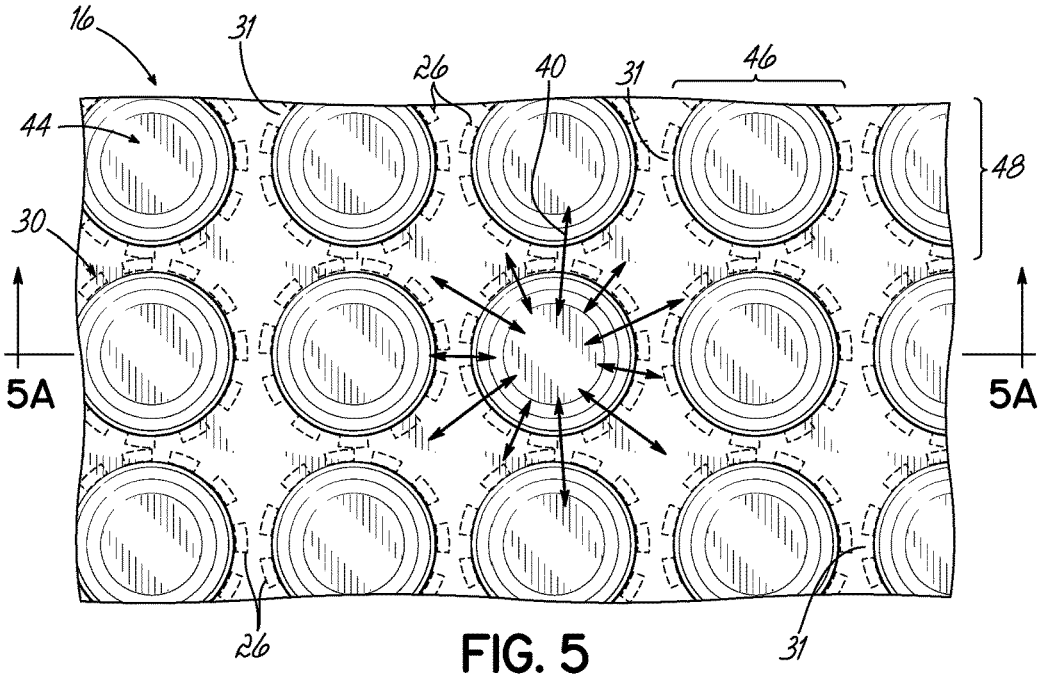
FIG. 5 is a top plan view of a portion of the comfort layer of FIG. 1, the arrows showing airflow inside the comfort layer.
Figure 5A:
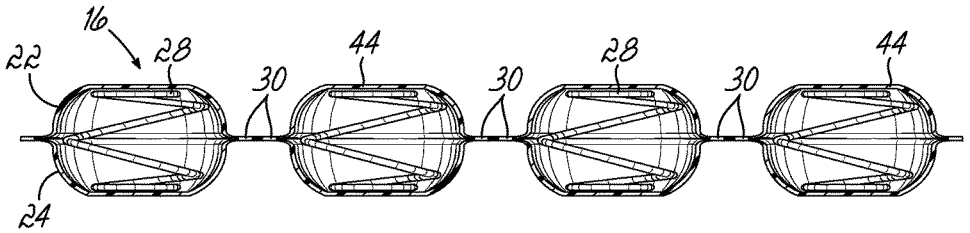
FIG. 5A is a cross-sectional view taken along the line 5A-5A of FIG. 5.
Figure 6:
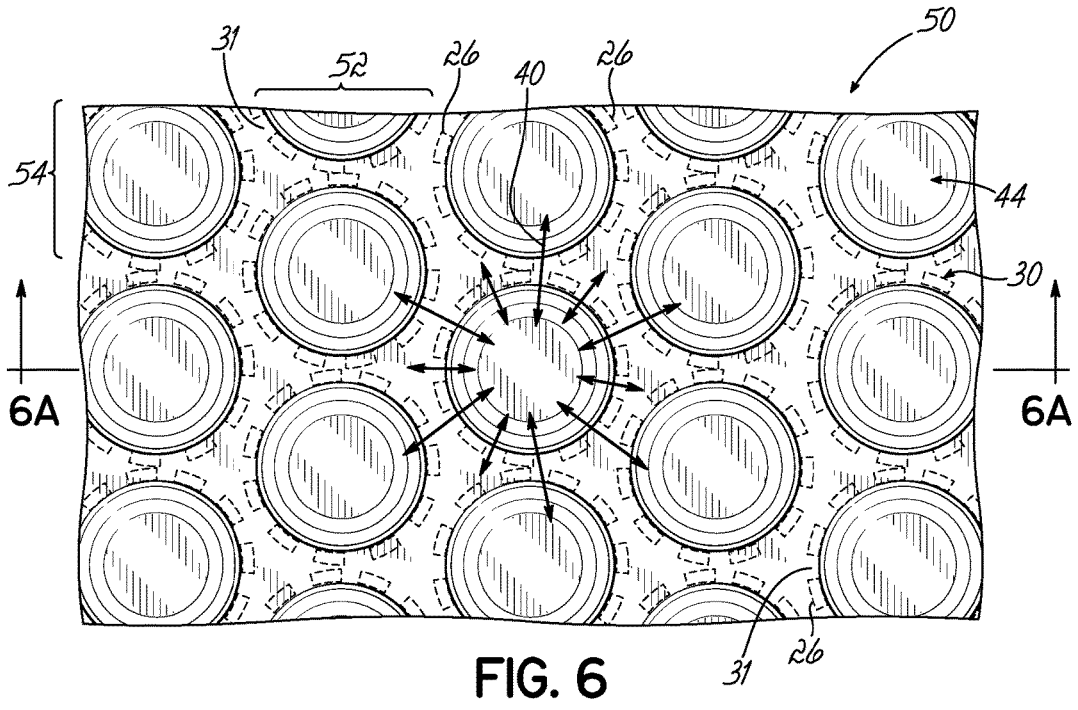
FIG. 6 is a top plan view of a portion of another comfort layer, the arrows showing airflow inside the comfort layer.
Figure 6A:
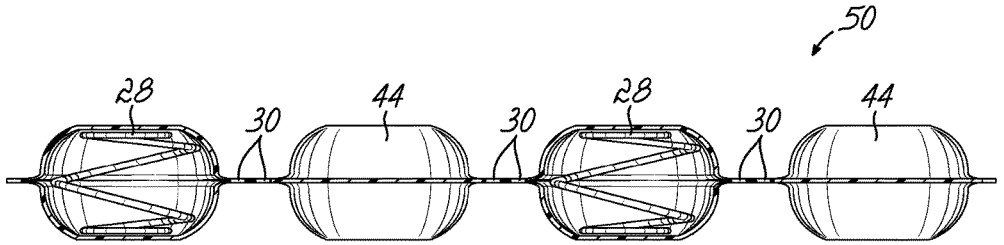
FIG. 6A is a cross-sectional view taken along the line 6A-6A of FIG. 6.

The size of the curved segments 26 of weld seams 30 are not intended to be limited by the illustrations; they may be any desired size depending upon the airflow desired inside the comfort layer. Similarly, the size, i.e., diameter of the illustrated weld seams 30, is not intended to be limiting. The placement of the weld seams 30 shown in the drawings is not intended to be limiting either. For example, the weld seams 30 may be organized into aligned rows and columns, as shown in FIGS. 5 and 5A or organized with adjacent columns being offset from each other, as illustrated in FIGS. 6 and 6A. Any desired arrangement of weld seams may be incorporated into any embodiment shown or described herein.

The weld segments may assume shapes other than the curved weld segments illustrated. For example, the weld seams may be circular around mini coil springs, but the weld segments may assume other shapes, such as triangles or circles or ovals of the desired size and pattern to obtain the desired airflow between adjacent pockets inside the comfort layer and into or out of the perimeter of the comfort layer.

In any of the embodiments shown or described herein, the mini coil springs 28 may be any desired size. One mini coil spring in a relaxed condition may be approximately two inches tall, have a diameter of approximately three inches and be made of seventeen and one-half gauge wire. While compressed inside one of the pockets 44, each of the mini coil springs 28 may be approximately one and one-half inches tall. However, the mini coil springs 28 in a relaxed condition may be any desired height, have any desired shape, such as an hourglass or barrel shape, have any desired diameter and/or be made of any desired wire thickness or gauge.

With reference to FIG. 4, there is illustrated a portion of a mobile ultrasonic welding horn 32 and anvil 42. The movable ultrasonic welding horn 32 has a plurality of spaced cut-outs or slots 34 along its lower edge 36. The remaining portions 38 of the ultrasonic welding horn's bottom 36 between the slots 34 are the portions which weld the two pieces of fabric 22, 24 together and create the curved weld segments 26. Along the ultrasonic welding horn's bottom edge 36, the ultrasonic welding horn 32 can be milled to make the slots a desired length to allow a desired airflow between the curved weld segments 26 as illustrated by the arrows 40 of FIG. 5. The airflows affect the feel/compression of the individually pocketed mini coil springs 28 when a user lays on the mattress 10.

As shown in FIG. 4, underneath the second ply 24 is an anvil 42 comprising a steel plate of $3/8^{th}$ inch thickness. However, the anvil may be any desired thickness. During the manufacturing process, the ultrasonic welding horn 32 contacts the anvil 42, the two plies of fabric 22, 24 therebetween, to create the circular weld seams 30 and hence, cylindrical-shaped pockets 44, at least one spring being in each pocket 44.

These curved weld segments 26 are created by the welding horn 32 of a machine (not shown) having multiple spaced protrusions 38 on the ultrasonic welding horn 32. As a result of these circular weld seams 30 joining plies 22, 24, the plies 22, 24 define a plurality of spring-containing pockets 44 of the comfort layer 16. One or more mini coil springs 28 may be contained within an individual pocket 44.

Figure 4A:
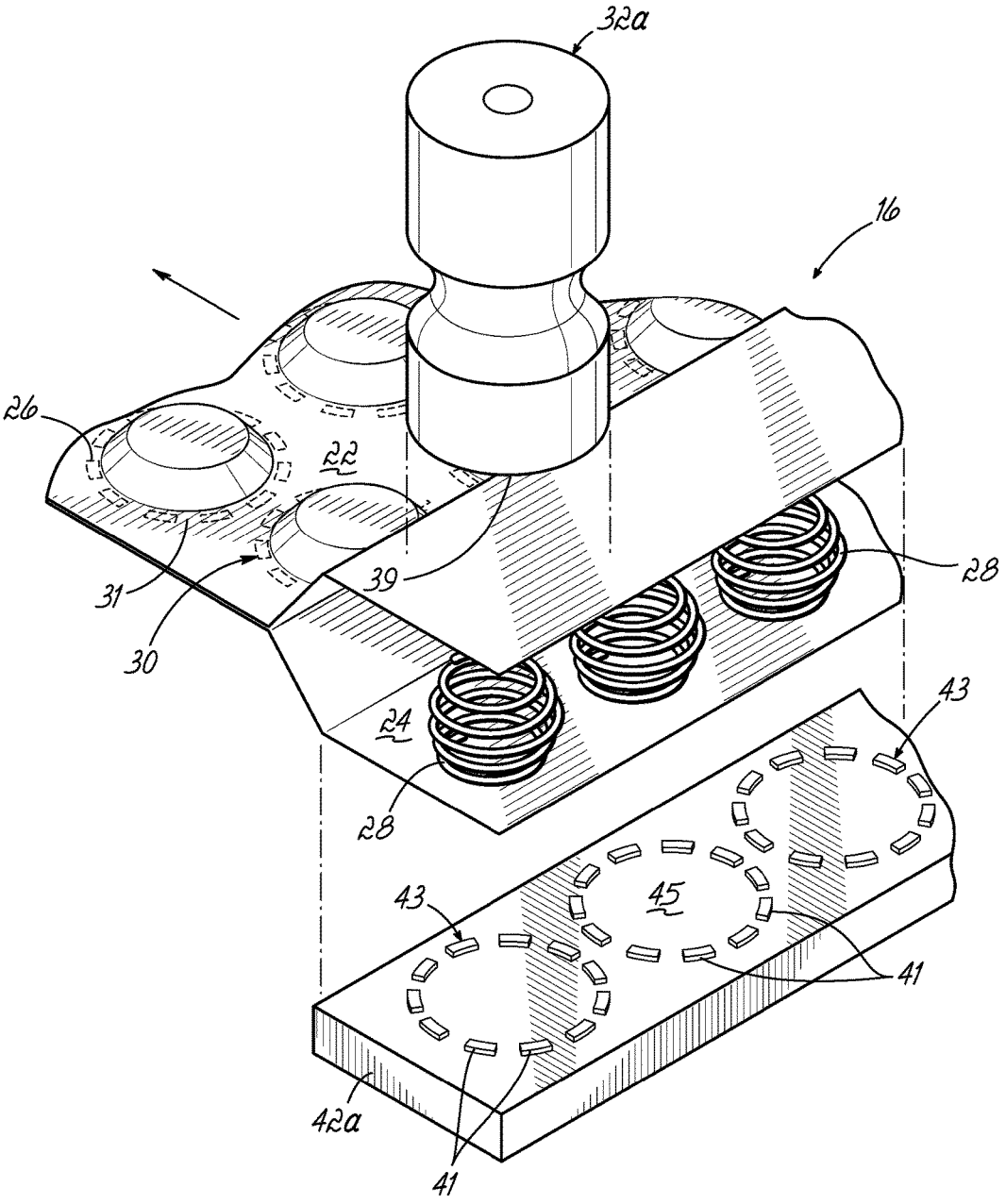
FIG. 4A is an enlarged perspective view of a portion of the comfort layer of FIG. 1 partially disassembled and showing a portion of another welding tool.

FIG. 4A illustrates another apparatus for forming the circular weld seams 30 comprising multiple curved segments 26 having gaps 31 therebetween for airflow. In this apparatus, the ultrasonic welding horn 32*a* has no protrusions on its bottom surface 39. Instead, the bottom surface 39 of ultrasonic welding horn 32*a* is smooth. As shown in FIG. 4A, the anvil 42*a* has a plurality of curved projections 41, which together form a projection circle 43. A plurality of projection circles 43 extend upwardly from the generally planar upper surface 45 of anvil 42*a*. When the ultrasonic welding horn 32*a* moves downwardly and sandwiches the plies 22, 24 of fabric between one of the projection circles 43 and the smooth bottom surface 39 of ultrasonic welding horn 32*a*, a circular weld seam 30 is created, as described above. Thus, a plurality of pockets 44 are created by the circular weld seams 30, each pocket 44 containing at least one mini coil spring 28.

In the embodiments in which the fabric material of plies 22, 24 defining pockets 44 and enclosing the mini coil springs 28 therein is non-permeable or impermeable to airflow, upon being subjected to a load, a pocket 44 containing at least one mini coil spring 28 is compressed by compressing the mini coil spring(s) 28 and air contained within the pocket 44. Air exits the pocket 44 through gaps 31 between the curved segments 26 of the circular weld seams 30. Similarly, when a load is removed from the pocket 44, the mini coil spring 28 separates the fabric layers 22, 24, and air re-enters the pocket 44 through the gaps 31 between the curved segments 26 of the circular weld seams 30. As shown in FIG. 5, the size of the gaps 31 between the segments 26 of circular seams 30 of perimeter pockets 44 defines how quickly air may enter or exit the comfort layer 16.

In the embodiments in which the fabric material is semi-impermeable to airflow, the rate at which the mini coil springs 28 compress when a load is applied to a pocketed spring core comfort layer 16 is slowed or retarded by the air entrapped within the individual pockets as the pocketed spring comfort layer 16 is compressed. Similarly, the rate of return of the compressed coil spring comfort layer to its original height after compression is retarded or slowed by the rate at which air may pass through the semi-impermeable fabric material into the interior of the individual pockets 44 of the pocketed spring comfort layer 16. In these embodiments, air passes through the gaps 31 between the curved segments 26 of the circular weld seams 30, as described above with respect to the embodiments having non-permeable fabric. However, in addition, some air passes through the fabric, both when the pocket 44 is compressed and when the pocket 44 is unloaded and enlarging or expanding due to the inherent characteristics of the mini springs 28.

As best illustrated in FIG. 5, the individual pockets 44 of comfort layer 16 may be arranged in longitudinally extending columns 46 extending from head-to-foot of the bedding product and transversely extending rows 48 extending from side-to-side of the bedding product. As shown in FIGS. 5 and 5A, the individual pockets 44 of one column 46 are aligned with the pockets 44 of adjacent columns 46.

Figure 5B:
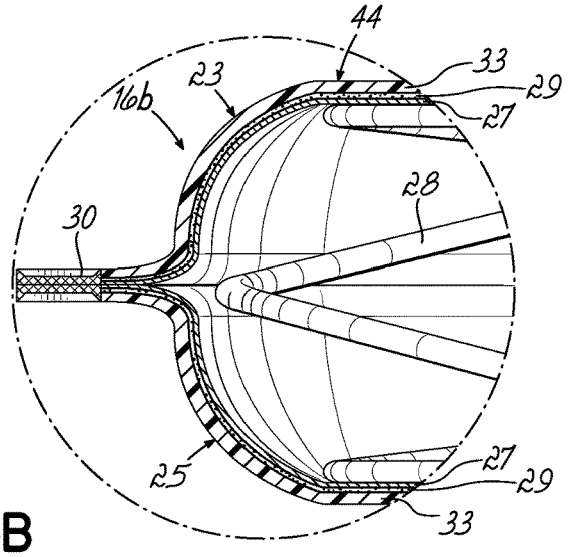
FIG. 5B is an enlarged cross-sectional view of an alternative embodiment having a different fabric.

FIG. 5B illustrates a portion of an alternative embodiment of comfort layer 16*b*. In this embodiment, the fabric material of each of the first and second plies 23, 25 may be a three-layered fabric impermeable to airflow. Each ply of fabric 23, 25 comprises three layers, including from the inside moving outwardly: 1) a protective layer of fabric 27; 2) an airtight layer 29; and 3) a sound attenuating or quieting layer 33. More specifically, the protective layer of fabric 27 may be a polypropylene non-woven fabric having a density of one ounce per square yard. The airtight layer 29 may be a thermoplastic polyurethane film layer having a thickness of approximately 1.0 mil (0.001 inches). The sound attenuating layer 33 may be a lofted polyester fiber batting having a density of 0.5 ounces per square foot. These materials and material specifications, such as the densities provided for the outer layers, have proven to be effective, but are not intended to be limiting. For example, the thickness of the impermeable middle layer of thermoplastic polyurethane film may be any desired thickness depending upon the desired characteristics of the multi-layered fabric and the composition of the multi-layered fabric. One middle layer, impermeable to airflow, which has proven to function satisfactory is 2.0 millimeters thick. The fiber batting layer need not be made of polyester; it may be made of other materials. Similarly, the fiber batting layer need not be lofted.

In any of the embodiments shown or described herein, the fabric material of at least one of the plies may be impermeable to airflow through the fabric. Each ply may comprise three layers, including from the inside moving outwardly: 1) a polypropylene non-woven fabric layer 27 having a density of approximately one ounce per square yard commercially available from Atex, Incorporated of Gainesville, Ga.; 2) a polyether thermoplastic polyurethane film layer 29 having a thickness of approximately 1.0 mil (0.001 inches) commercially available from American Polyfilm, Incorporated of Branford, Conn.; and 3) a lofted needle punch polyester fiber batting layer 33 having a density of 0.5 ounces per square foot commercially available from Milliken & Company of Spartanburg, S.C. The middle thermoplastic polyurethane film layer 29 is impermeable to airflow and may be any desired thickness. One thickness which has proven to function satisfactory is 2.0 millimeters. The lofted needle punch polyester fiber batting layer 33 acts as a sound dampening layer which quiets and muffles the film layer 29 as the springs are released from a load (pressure in the pocket goes from positive to negative) or loaded (pressure in the pocket goes from neutral to positive). The polypropylene non-woven fabric layer 27 keeps the segmented air passages open such that the pocket 44 may "breathe". Without the polypropylene non-woven fabric layer 27 closest to the springs, the middle thermoplastic polyurethane film 29 would cling to itself and not allow enough air to pass through the segmented air passages. The polypropylene non-woven fabric layer 27 closest to the springs also makes the product more durable by protecting the middle thermoplastic polyurethane film layer 29 from contacting the spring 28 and deteriorating from abrasion against the spring 28.

Heat-activated glue may be placed between the airtight layer 29 and the sound attenuating layer 33. The airtight layer 29 and the sound attenuating layer 33 may then be laminated together by passing them through a heat-activated laminator (not shown). The protective layer 27 may or may not be glue laminated to the other two layers. After passing through the heat-activated laminator, at least two of the three layers may be combined.

An alternative method for laminating all three layers without the use of glue may be using an ultrasonic lamination procedure. This process creates ultrasonic welds in a set pattern across the fabric, thereby making the fabric a unitary three-layered piece of material.

FIGS. 6 and 6A illustrate another comfort layer 50 having the same pockets 44 and same springs 28 as does the embodiment of comfort layer 16 of FIGS. 1-5A. As best illustrated in FIG. 6, the individual pockets 44 of comfort layer 50 are arranged in longitudinally extending columns 52 extending from head-to-foot of the bedding product and transversely extending rows 54 extending from side-to-side of the bedding product. As shown in FIGS. 6 and 6A, the individual pockets 44 of one column 52 are offset from, rather than aligned with, the pockets 44 of the adjacent columns 52.

Figure 7:
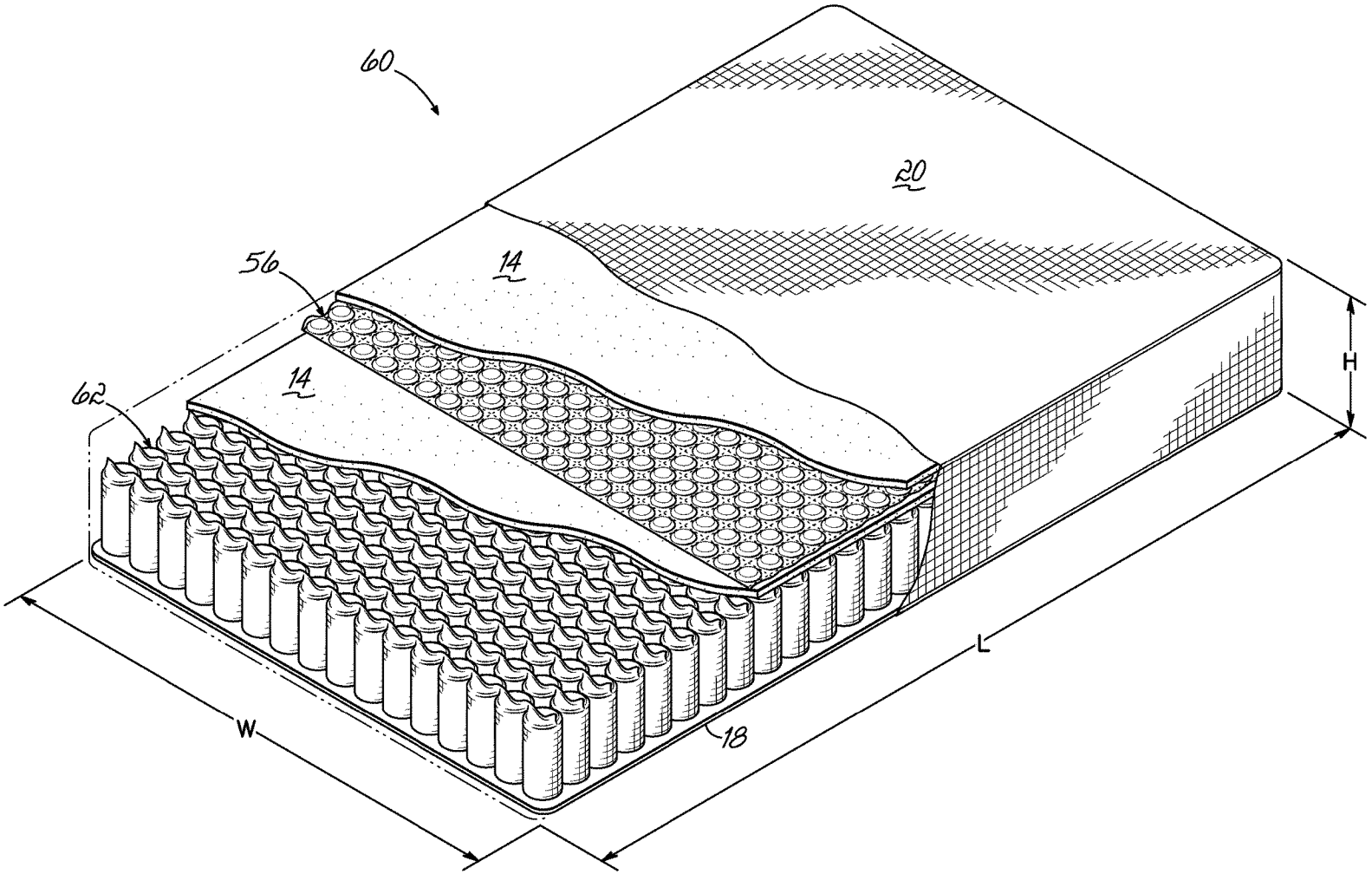
FIG. 7 is a perspective view, partially broken away, of a bedding product incorporating another embodiment of comfort layer in accordance with the present invention.

FIG. 7 illustrates an alternative embodiment of comfort layer 56 incorporated into a single-sided mattress 60. Single-sided mattress 60 comprises a pocketed spring core 62, a cushioning pad 14 on top of the pocketed spring core 62, a base 18, another cushioning pad 14 above comfort layer 56, and a cover 20, such as an upholstered covering. Pocketed spring core 62 may be incorporated into any bedding or seating product, including a double-sided mattress, and is not intended to be limited to single-sided mattresses. As described above, comfort layer 56 may be used in any bedding or seating product, including a spring core made with non-pocketed springs, such as coil springs.

As shown in FIG. 7, mattress 60 has a longitudinal dimension or length L, a transverse dimension or width W and a height H. Although the length L is shown as being greater than the width W, they may be identical. The length, width and height may be any desired distance and are not intended to be limited by the drawings.

Figure 9:
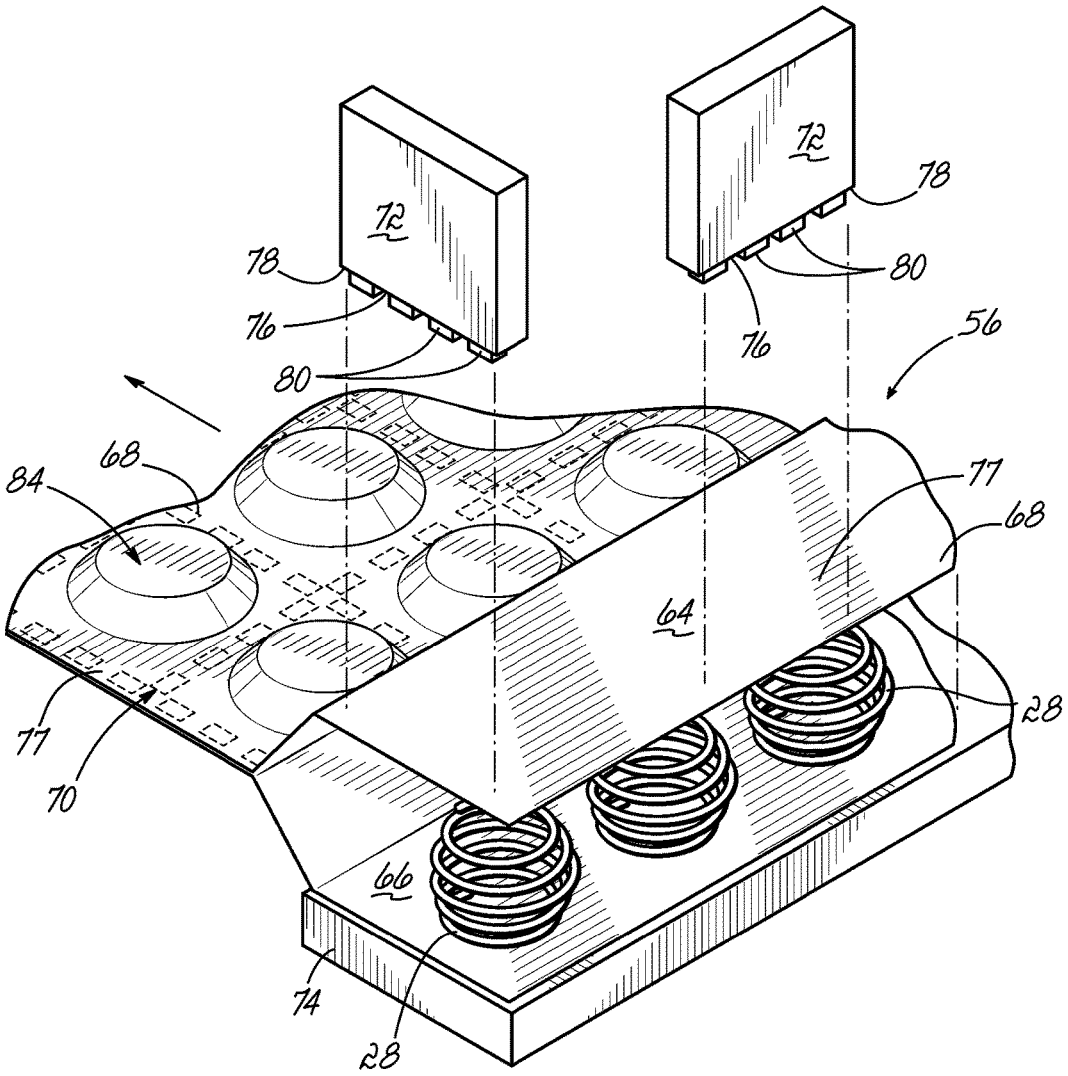
FIG. 9 is an enlarged perspective view of a portion of the comfort layer of FIG. 7 partially disassembled and showing a portion of a welding tool.

FIG. 9 illustrates the components of the comfort layer 56 incorporated into the mattress 60 shown in FIG. 7. The comfort layer 56 comprises a first ply of fabric 64 and a second ply of fabric 66 joined with linear or straight weld seams 70, each weld seam 70 comprising multiple linear weld segments 68. These weld seams 70 are strategically placed around a mini coil spring 28 and create a rectangular containment or pocket 84 made from intersecting weld seams 70. During the welding process, the mini coil springs 28 may be compressed. The length and/or width of the linear weld segments 68 of weld seams 70 is not intended to be limited to those illustrated; the weld segments may be any desired size depending upon the airflow desired through the comfort layer.

Similarly, the shape, as well as the size, of the weld seams of any of the weld seams shown or described herein is not intended to be limiting. Shapes other than linear weld segments 68 may be used to create weld seams 70, as well as any weld seams shown or described herein. For purposes of this document, "weld segment" is not intended to be limited to linear segments. A "weld segment" of a weld seam is intended to include such shapes as triangles or circles or ovals of any desired size and pattern to obtain the desired airflow between adjacent pockets and into or out of the perimeter of the comfort layer.

With reference to FIG. 9, there is illustrated a portion of an ultrasonic welding horn 72 and anvil 74. The mobile or movable ultrasonic welding horn 72 has a plurality of spaced cut-outs or slots 76 between projections 80. The projections 80 of the ultrasonic welding horn 72 are the portions which weld the two pieces of fabric 64, 66 together and create the linear weld segments 68 along weld seams 70. Along the ultrasonic welding horn's lower portion 78, the ultrasonic welding horn 72 can be milled to allow a desired airflow between the linear weld segments 68 as illustrated by the arrows 82 of FIG. 7. The airflows affect the feel/compression of the individually pocketed mini coil springs 28 when a user lays on the mattress 60.

As shown in FIG. 9, underneath the second ply 66 is an anvil 74 comprising a steel plate of ⅜$^{th}$ inch thickness. However, the anvil may be any desired thickness. During the manufacturing process, the ultrasonic welding horn 72 contacts the anvil 74, the two plies of fabric 64, 66 being therebetween, to create the intersecting linear weld seams 70 and, hence, pockets 84, at least one spring 28 being in each pocket 84. See FIGS. 10 and 10A.

Figure 10:
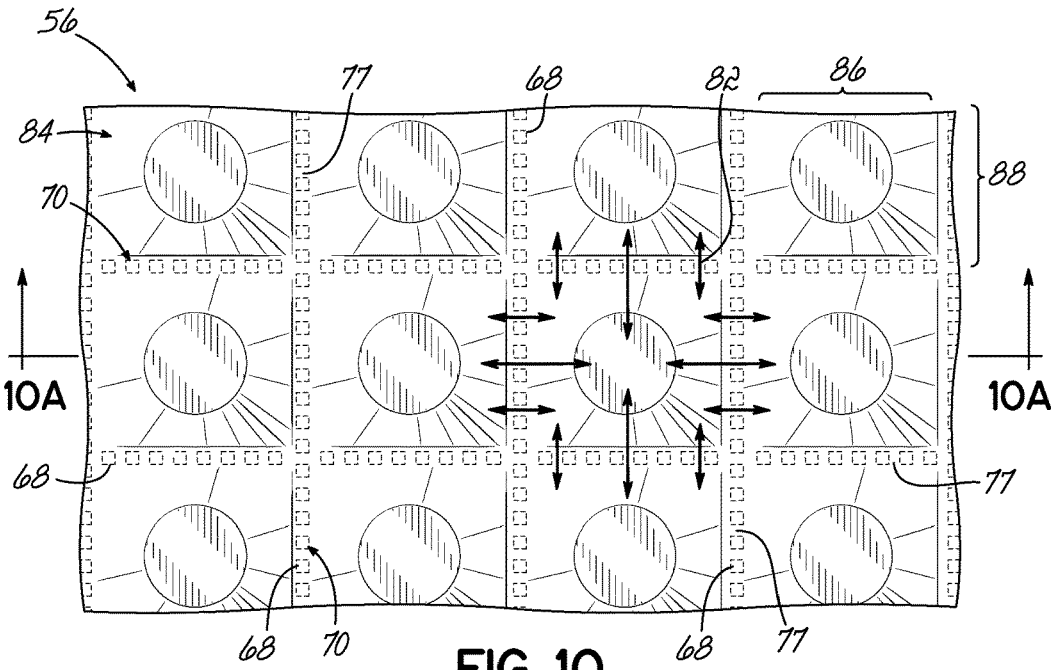
FIG. 10 is a top plan view of a portion of the comfort layer of FIG. 7, the arrows showing airflow inside the comfort layer.

These linear weld segments 68 may be created by the welding horn 72 of a machine (shown in FIG. 8 and described below) having multiple spaced protrusions 80 on the ultrasonic welding horn 72. As a result of these linear or straight intersecting weld seams 70 defining the spring-containing pockets 84 of the comfort layer 56, each mini coil spring 28 is contained within its own individual pocket 84. Air exits the pocket 84 through gaps 77 between the weld segments 68 of the intersecting weld seams 70. Similarly, when a load is removed from the pocket 84, the mini coil spring 28 separates the fabric layers 64, 66, and air re-enters the pocket 84 though the gaps 77 between the weld segments 68 of the intersecting weld seams 70. As shown in FIG. 10, the size of the gaps 77 between the segments 68 of intersecting weld seams 70 of the pockets 84 defines how quickly air may enter or exit the pockets 84 of the comfort layer 56.

Figure 9A:
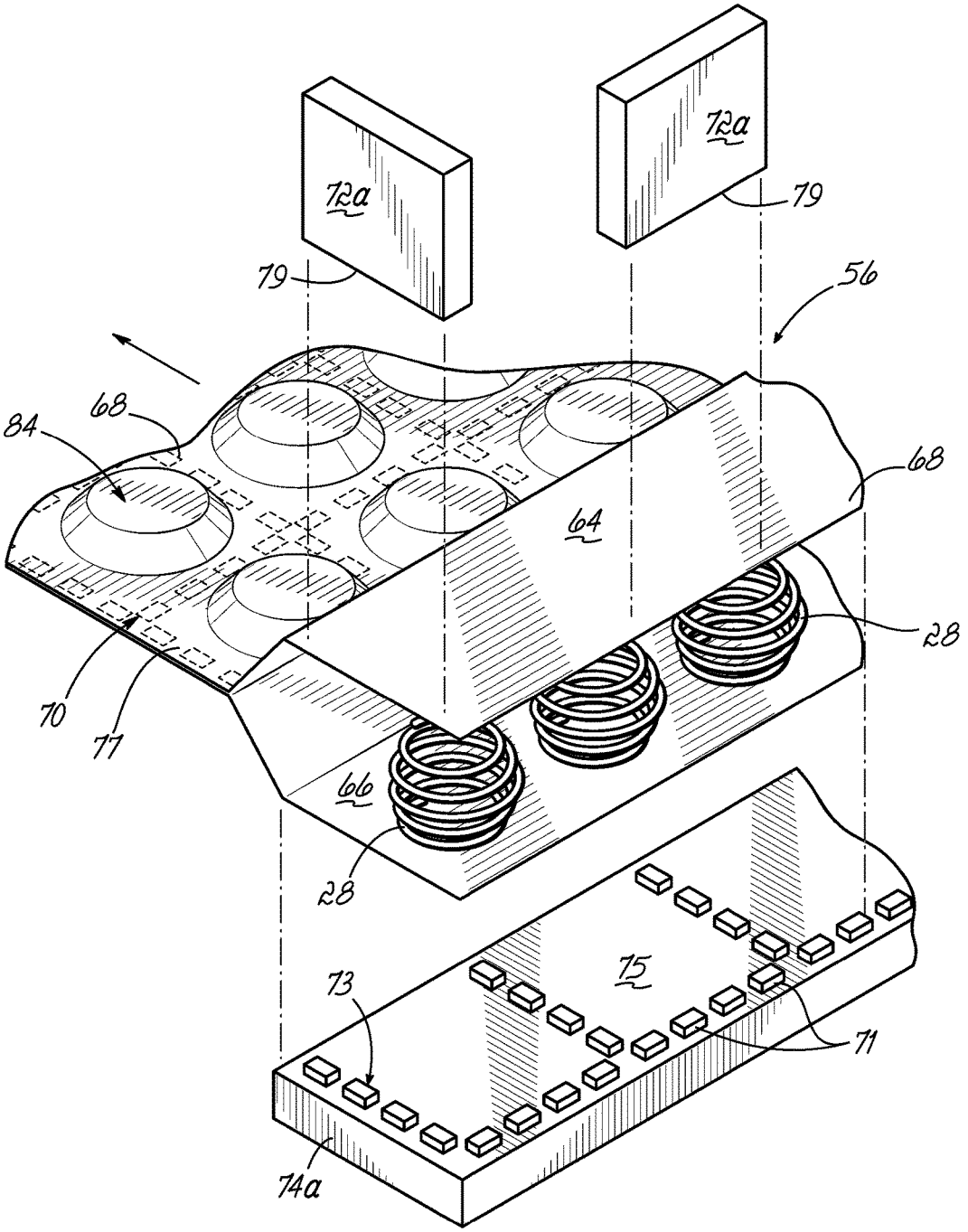
FIG. 9A is an enlarged perspective view of a portion of the comfort layer of FIG. 7 partially disassembled and showing a portion of another welding tool.

FIG. 9A illustrates another apparatus for forming the linear weld seams 70, each weld seam 70 comprising multiple linear weld segments 68 having gaps 77 therebetween for airflow. In this apparatus, the ultrasonic welding horn 72*a* has no protrusions on its bottom surface 79. Instead, the bottom surface 79 of ultrasonic welding horn 72*a* is smooth. The anvil 74*a* has a plurality of linear projections 71, which together form a projection pattern 73, shown in FIG. 9A. A plurality of spaced projections 71 in pattern 73 extend upwardly from the generally planar upper surface 75 of anvil 74*a*. When the ultrasonic welding horn 72*a* moves downwardly and sandwiches the plies 64, 66 of fabric between the projections 71 and the smooth bottom surface 79 of ultrasonic welding horn 72*a*, intersecting weld seams 70 are created. Thus, a plurality of pockets 84 are created by the intersecting weld seams 70, each pocket 84 containing at least one mini coil spring 28.

In some embodiments, the fabric material defining pockets 84 and enclosing the mini coil springs 28 therein is non-permeable to airflow. When subjected to a load, these pockets 84 (with mini coil springs 28 therein) are compressed, causing the air contained within the pockets 84 to move between pockets 84, as shown by arrows 82 of FIGS. 10 and 11A, until the air exits the perimeter pockets 84 into the atmosphere, as shown in FIG. 11A. Due to such fabric material being impermeable to air, the rate at which the mini springs 28 compress when a load is applied to a pocketed spring core comfort layer 56 containing the mini coil springs 28 is slowed or retarded by the size of the gaps 77 between the linear weld segments 68 of intersecting weld seams 70. Upon removal of the load, the rate of return of the spring comfort layer 56 to its original height depends upon the mini coil springs 28 in the pockets 84 returning to their original height, causing separation of the layers of fabric, drawing air into the pockets 84 through the gaps 77 between the linear weld segments 68 of intersecting weld seams 70.

In other embodiments, the fabric material is semi-impermeable to airflow, and some air passes through the fabric. The rate at which the mini springs 28 compress when a load is applied to a pocketed spring core comfort layer 56 is slowed or retarded by the air entrapped within the individual pockets 84 as the pocketed spring comfort layer 56 is compressed and, similarly, the rate of return of the compressed coil spring comfort layer 56 to its original height after compression is retarded or slowed by the rate at which air may pass through the semi-impermeable fabric material into the interior of the individual pockets 84 of the pocketed spring comfort layer 56. In these embodiments, air passes through the gaps 77 between the weld segments 68 of the weld seams 70, as described above with respect to the embodiments having non-permeable fabric. However, in addition, some air passes through the fabric, both when the pocket 84 is compressed and when the pocket 84 is expanded due to the spring(s) therein.

In accordance with the practice of this invention, one fabric material semi-impermeable to airflow, which may be used in either of the two plies of the pocketed spring comfort layers disclosed or shown herein, may be a multi-layered material, including one layer of woven fabric as, for example, a material available from Hanes Industries of Conover, N.C. under product names Eclipse 540. In testing, using a 13.5 inch disc platen loaded with a 25 pound weight, six locations on a queen size mattress were tested to determine the time required for the pocketed mini coil springs of a comfort layer having rectangular-shaped weld seams made with the multi-layered fabric material described above to compress to half the distance of its starting height. Once the weight of the platen was removed, the time for the pocketed mini coil springs of the comfort layer to return to their starting height was measured. Using such a testing method, the average rate of compression was 0.569 inches per second, and the average rate of recovery was 0.706 inches per second. These averages are not intended to be limiting. These averages may be dependent upon the type(s) of material of the plies and/or size and shape of the weld segments comprising the weld seams which, in turn, may vary the rate of compression and rate of recovery due to airflow. Such variables may be adjusted/changed to achieve variations in feel and comfort of the end product.

In an air permeability test known in the industry as the ASTM Standard D737, 2004 (2012), "Standard Test Method for Air Permeability of Textile Fabrics," ASTM International, West Conshohocken, Pa. 2010, airflow through the multi-layered, semi-impermeable material available from Hanes Industries of Conover, N.C. described above was measured. The results ranged between 0.029-0.144 cubic feet per minute.

Alternatively, the fabric material of the first and second plies of any of the embodiments shown or disclosed herein may be material disclosed in U.S. Pat. Nos. 7,636,972; 8,136,187; 8,474,078; 8,484,487 and 8,464,381, each one of which is fully incorporated herein. In accordance with the practice of this invention, this material may have one or more coatings of acrylic or other suitable material sprayed onto or roller coated onto one side of the fabric to make the fabric semi-impermeable to airflow as described hereinabove.

Figure 10A:
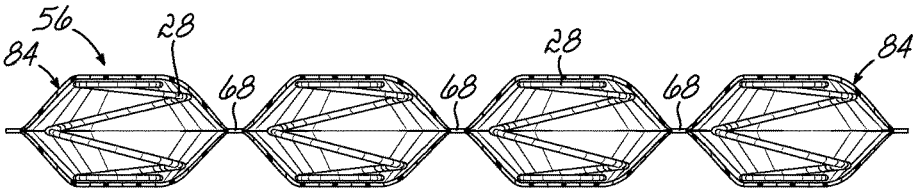
FIG. 10A is a cross-sectional view taken along the line 10A-10A of FIG. 10.
Figure 10B:
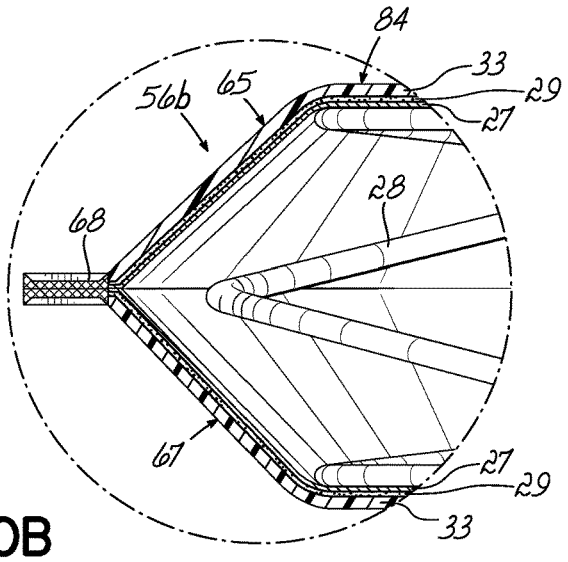
FIG. 10B is an enlarged cross-sectional view of an alternative embodiment having a different fabric.

FIG. 10B illustrates a portion of an alternative embodiment of comfort layer 56*b*. In this embodiment, the fabric material of each of the first and second plies 65, 67 may be the same three-layered fabric impermeable to airflow shown in FIG. 5B and described above. This three-layered fabric impermeable to airflow may be used in any embodiment shown or described herein, including for any pocketed spring core. Each ply of fabric 65, 67 comprises three layers, including from the inside moving outwardly: 1) a protective layer of fabric 27; 2) an airtight layer 29; and 3) a sound attenuating or quieting layer 33. If desired, the protective layer of fabric 27 may be omitted. More specifically, the protective layer of fabric 27 may be a polypropylene non-woven fabric having a density of one ounce per square yard. The airtight layer 29 may be a thermoplastic polyurethane film layer having a thickness of approximately 1.0 mil (0.001 inches). The sound attenuating layer 33 may be a lofted polyester fiber batting having a density of 0.5 ounces per square foot. These materials and material specifications, such as the densities provided for the outer layers, have proven to be effective, but are not intended to be limiting. For example, the thickness of the middle layer 29 impermeable to airflow may vary depending upon the desired characteristics of the multi-layered fabric. The fiber batting layer need not be made of polyester; it may be made of other materials. Similarly, the fiber batting layer need not be lofted.

In any of the embodiments shown or described herein, the fabric material of at least one of the plies may be impermeable to airflow through the fabric. Each ply may comprise three layers, including from the inside moving outwardly: 1) a polypropylene non-woven fabric layer 27 having a density of approximately one ounce per square yard commercially available from Atex, Incorporated of Gainesville, Ga.; 2) a polyether thermoplastic polyurethane film layer 29 having a thickness of approximately 1.0 mil (0.001 inches) commercially available from American Polyfilm, Incorporated of Branford, Conn.; and 3) a lofted needle punch polyester fiber batting layer 33 having a density of 0.5 ounces per square foot commercially available from Milliken & Company of Spartanburg, S.C. The middle thermoplastic polyurethane film layer 29 is impermeable to airflow. The lofted needle punch polyester fiber batting layer 33 acts as a sound-dampening layer which quiets and muffles the film layer 29 as the springs are released from a load (pressure in the pocket goes from positive to negative) or loaded (pressure in the pocket goes from neutral to positive). The polypropylene non-woven fabric layer 27 keeps the segmented air passages open, such that the pocket 84 may "breathe". Without the polypropylene non-woven fabric layer 27 closest to the springs 28, the middle thermoplastic polyurethane film 29 would cling to itself and not allow enough air to pass through the segmented air passages. The polypropylene non-woven fabric layer 27 closest to the springs 28 also makes the product more durable by protecting the middle thermoplastic polyurethane film layer 29 from contacting the spring 28 and deteriorating from abrasion against the spring 28.

Heat-activated glue may be placed between the airtight layer 29 and the sound attenuating layer 33. In some applications, additional heat active glue may be placed between the airtight layer 29 and the protective layer 27. At least two layers may then be laminated together by passing them through a heat-activated laminator (not shown). The protective layer 27 may remain unattached to the other two layers after passing through the laminator. However, in some processes after passing through the heat-activated laminator, all three layers may be combined and form one of the fabric plies. An alternative method for laminating all three layers may be using an ultrasonic lamination procedure. This process creates ultrasonic welds in a set pattern across the fabric, thereby making it one piece or ply of material.

As best illustrated in FIG. 10, the individual pockets 84 of comfort layer 56 may be arranged in longitudinally extending columns 86 extending from head-to-foot of the bedding product and transversely extending rows 88 extending from side-to-side of the bedding product. As shown in FIGS. 10 and 10A, the individual pockets 84 of one column 86 are aligned with the pockets 84 of the adjacent columns 86. Air may flow between pockets 84 and into and out of the comfort layer 56 between the linear segments 68 of weld seams 70.

Figure 11:
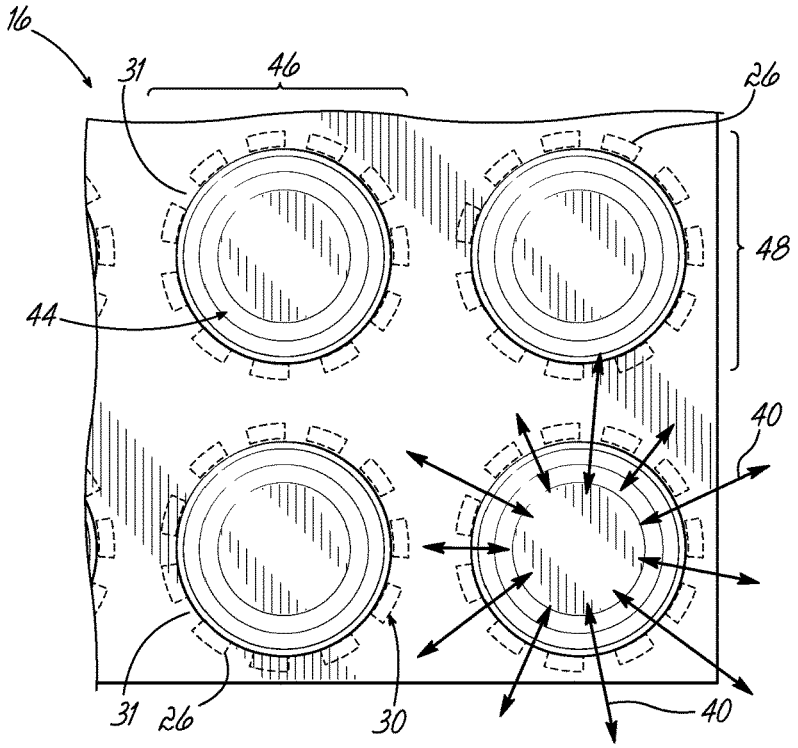
FIG. 11 is a top plan view of a corner portion of the comfort layer of FIG. 1, the arrows showing airflow into and out of the comfort layer.
Figure 11A:
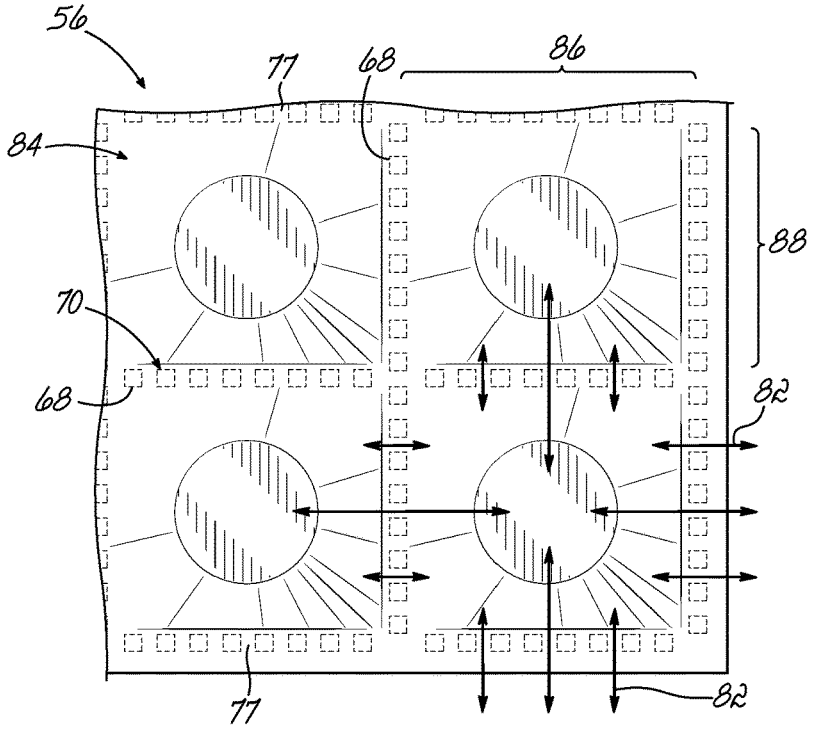
FIG. 11A is a top plan view of a corner portion of the comfort layer of FIG. 7, the arrows showing airflow into and out of the comfort layer.

FIG. 11 illustrates one corner of comfort layer 16 of mattress 10 showing airflow between the curved weld segments 26 of the peripheral pockets 44, as illustrated by the arrows 40. Although FIG. 11 illustrates the arrows 40 only on one corner pocket 44, each of the pockets 44 around the periphery of the comfort layer 16 allows airflow through the gaps 31 between the weld segments 26 of circular seams 30. This airflow controls the amount of air entering the comfort layer 16 when a user changes position or gets off the bedding or seating product, thus allowing the springs 28 in the pockets 44 to expand and air to flow into the comfort layer 16. Similarly, when a user gets onto a bedding or seating product, the springs 28 compress and cause air to exit the pockets 44 around the periphery of the comfort layer 16 and exit the comfort layer. The amount of air exiting the comfort layer 16 affects the feel/compression of the individually pocketed mini coil springs 28 when a user lays on the mattress 10.

FIG. 11A illustrates one corner of comfort layer 56 of mattress 60 of FIG. 7 showing airflow between the weld segments 68 of the peripheral pockets 84, as illustrated by the arrows 82. Although FIG. 11A illustrates the arrows 82 only on one corner pocket 84, each of the pockets 84 around the periphery of the comfort layer 56 allows airflow through the gaps 77 between the weld segments 68 of intersecting weld seams 70. This airflow controls the amount of air entering the comfort layer 56 when a user changes position or gets off the bedding or seating product, thus allowing the springs 28 in the pockets 84 to expand and air to flow into the comfort layer 56. Similarly, when a user changes position or gets onto a bedding or seating product, the springs 28 compress and cause air to exit the pockets 84 around the periphery of the comfort layer 16 and exit the comfort layer. The amount of air exiting the comfort layer 56 affects the feel/compression of the individually pocketed mini coil springs 28 when a load is applied to the mattress 10.

Figure 12:
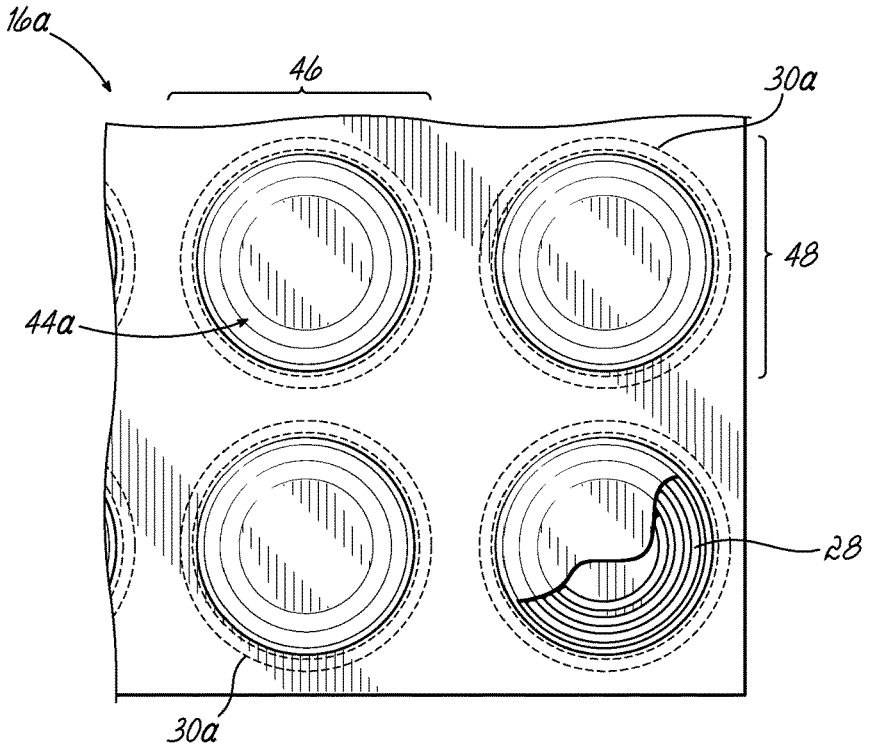
FIG. 12 is a top plan view of a corner portion of another embodiment of comfort layer.

FIG. 12 illustrates one corner of an alternative embodiment of comfort layer 16*a*, which may be used in any bedding or seating product. The comfort layer 16*a* comprises aligned rows 48 and columns 46 of pockets 44*a*, each pocket 44*a* comprising a circular seam 30*a* joining upper and lower plies of fabric, as described above. However, each of the circular seams 30*a* is a continuous seam, as opposed to a seam having curved weld segments with gaps therebetween to allow airflow through the circular seam. These circular seams 30*a* of pockets 44*a* allow no airflow through the seams 30*a*. Therefore, the fabric material of the first and second plies of pockets 44*a* of comfort layer 16*a* must be made of semi-impermeable material to manage or control airflow into and out of the pockets 44*a* of comfort layer 16*a*. The type of material used for comfort layer 16*a* solely controls the amount of air entering the comfort layer 16*a* when a user gets off the bedding or seating product, thus allowing the springs 28 in the pockets 44*a* to expand and air to flow into the comfort layer 16*a*. Similarly, when a user gets onto a bedding or seating product, the springs 28 compress and cause air to exit the pockets 44*a* of the comfort layer 16*a* and exit the comfort layer. The amount of air exiting the comfort layer 16*a* affects the feel/compression of the individually pocketed mini coil springs 28 when a user lays on the product incorporating the comfort layer 16*a*.

Figure 12A:
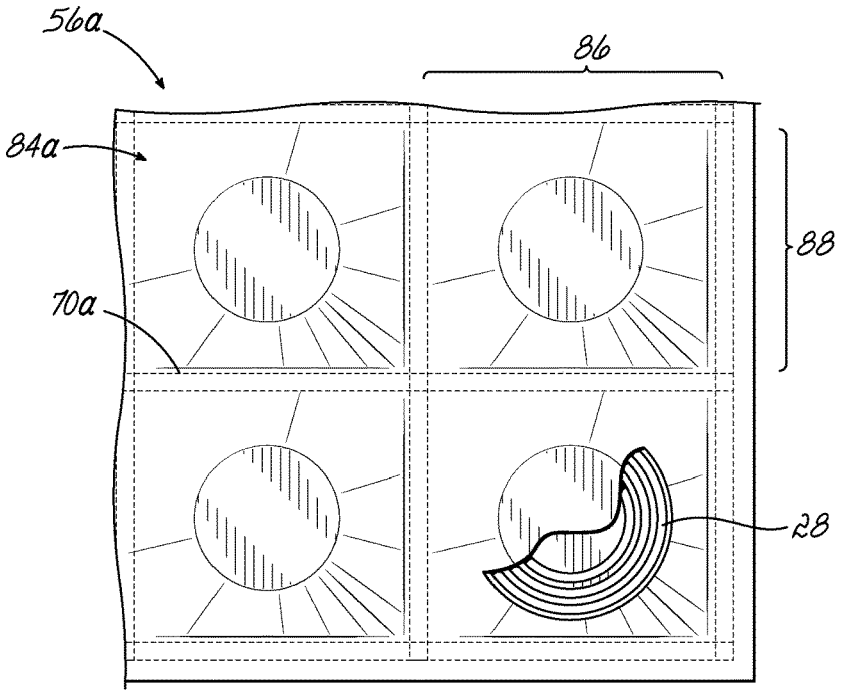
FIG. 12A is a top plan view of a corner portion of another embodiment of comfort layer.

FIG. 12A illustrates one corner of an alternative embodiment of comfort layer 56*a*, which may be used in any bedding or seating product. The comfort layer 56*a* comprises aligned rows 88 and columns 86 of pockets 84*a*, each pocket 84*a* comprising intersecting weld seams 70*a* joining upper and lower plies of fabric as described above. However, each of the intersecting weld seams 70*a* is a continuous seam, as opposed to a seam having weld segments with gaps therebetween to allow airflow through the seam. These intersecting weld seams 70*a* of pockets 84*a* allow no airflow through the weld seams 70*a*. Therefore, the fabric material of the first and second plies of pockets 84*a* of comfort layer 56*a* must be made of semi-impermeable material to allow some airflow into and out of the pockets 84*a* of comfort layer 56*a*. The type of material used for comfort layer 56*a* solely controls the amount of air entering the comfort layer 56*a* when a user gets off the bedding or seating product, thus allowing the springs 28 in the pockets 84*a* to expand and air to flow into the comfort layer 56*a*. Similarly, when a user gets onto a bedding or seating product, the springs 28 compress and cause air to exit the pockets 84*a* of the comfort layer 56*a* and exit the comfort layer. The amount of air exiting the comfort layer 56*a* affects the feel/compression of the individually pocketed mini coil springs 28 when a user lays on the product incorporating the comfort layer 56*a*.

Figure 2:
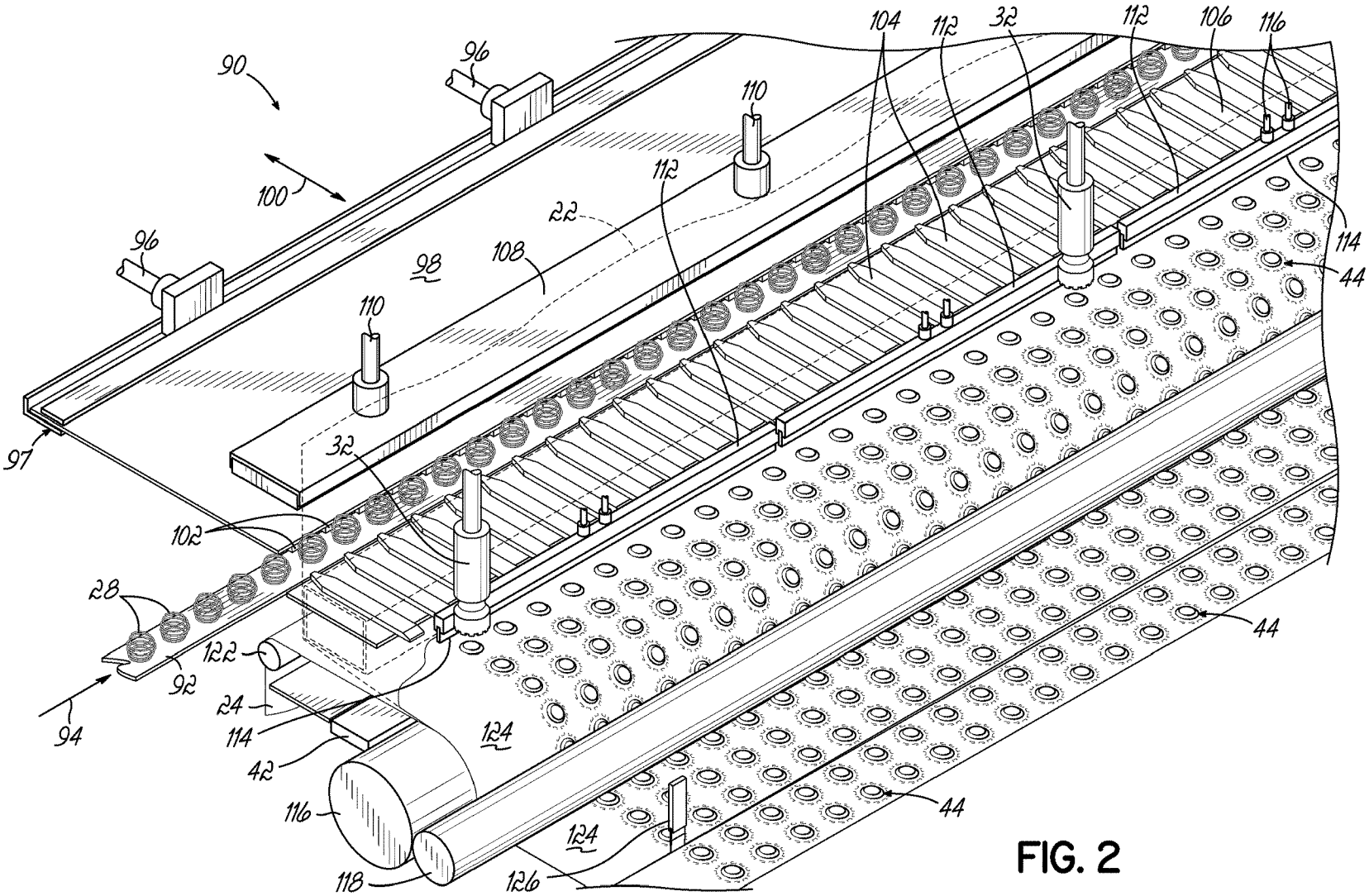
FIG. 2 is a perspective view of the comfort layer of FIG. 1 being manufactured.

FIG. 2 illustrates a machine 90 used to make several of the comfort layers shown and disclosed herein, including comfort layer 16 shown in FIG. 1. Some parts of the machine 90 may be changed to make other comfort layers shown or described herein, such as comfort layer 56 shown in FIG. 7. Machine 90 comprises a pair of ultrasonic welding horns 32, and at least one stationary anvil 42, as shown in FIG. 4. Alternatively, ultrasonic welding horns 32*a* and anvil 42*a* of FIG. 4A may be used in the machine.

Figure 2A:
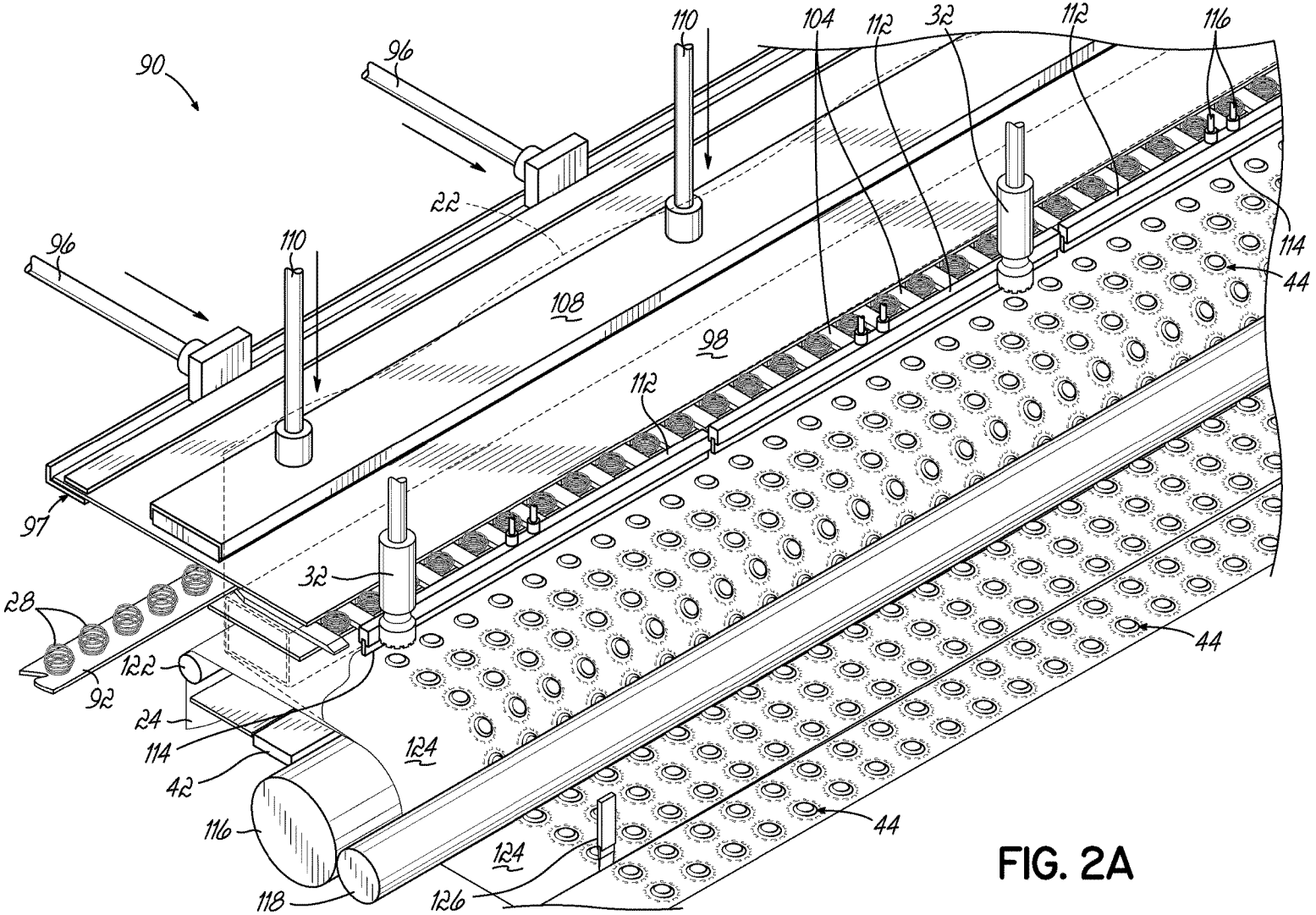
FIG. 2A is a perspective view of a portion of the machine of FIG. 2, the coil springs being inserted into predetermined positions.

Machine 90 discloses a conveyor 92 on which are loaded multiple mini coil springs 28. The conveyor 92 moves the mini coil springs 28 in the direction of arrow 94 (to the right as shown in FIG. 2) until the mini coil springs 28 are located in predetermined locations, at which time the conveyor 92 stops moving. Machine 90 further discloses several actuators 96, which move a pusher assembly 97, including a pusher plate 98 in the direction of arrow 100. Although two actuators 96 are illustrated in FIGS. 2 and 2A, any number of actuators 96 of any desired configuration may be used to move the pusher assembly 97. The pusher plate 98 has a plurality of spaced spring pushers 102 secured to the pusher plate 98 underneath the pusher plate 98. The spring pushers 102 push the mini coil springs 28 between stationary guides 104 from a first position shown in FIG. 2 to a second position shown in FIG. 4 in which the mini coil springs 28 are located above the stationary anvil 42 (or above the alternative anvil 42*a* shown in FIG. 4A). FIG. 2A illustrates the mini coil springs 28 being transported from the first position to the second position, each mini coil spring 28 being transported between adjacent stationary guides 104. The stationary guides 104 are secured to a stationary mounting plate 106.

The machine 90 further comprises a compression plate 108, which is movable between raised and lowered positions by lifters 110. Although two lifters 110 are illustrated in FIGS. 2 and 2A, any number of lifters 110 of any desired configuration may be used to move the compression plate 108.

Figure 3A:
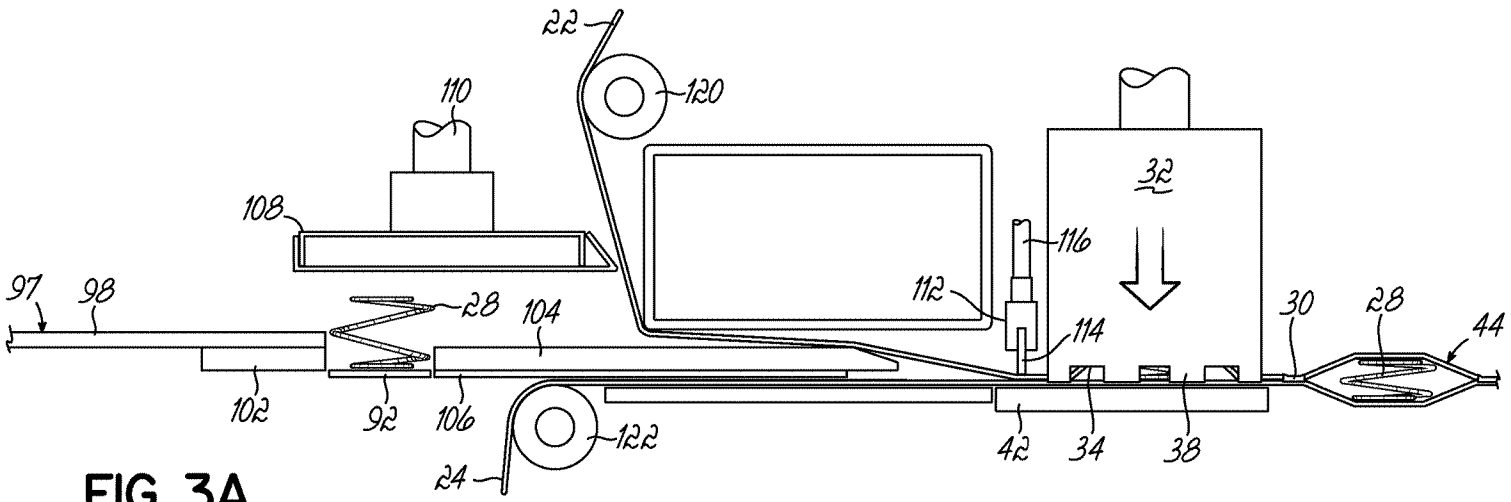
FIG. 3A is a cross-sectional view of a beginning portion of the manufacturing process using the machine of FIGS. 2 and 2A.
Figure 3B:
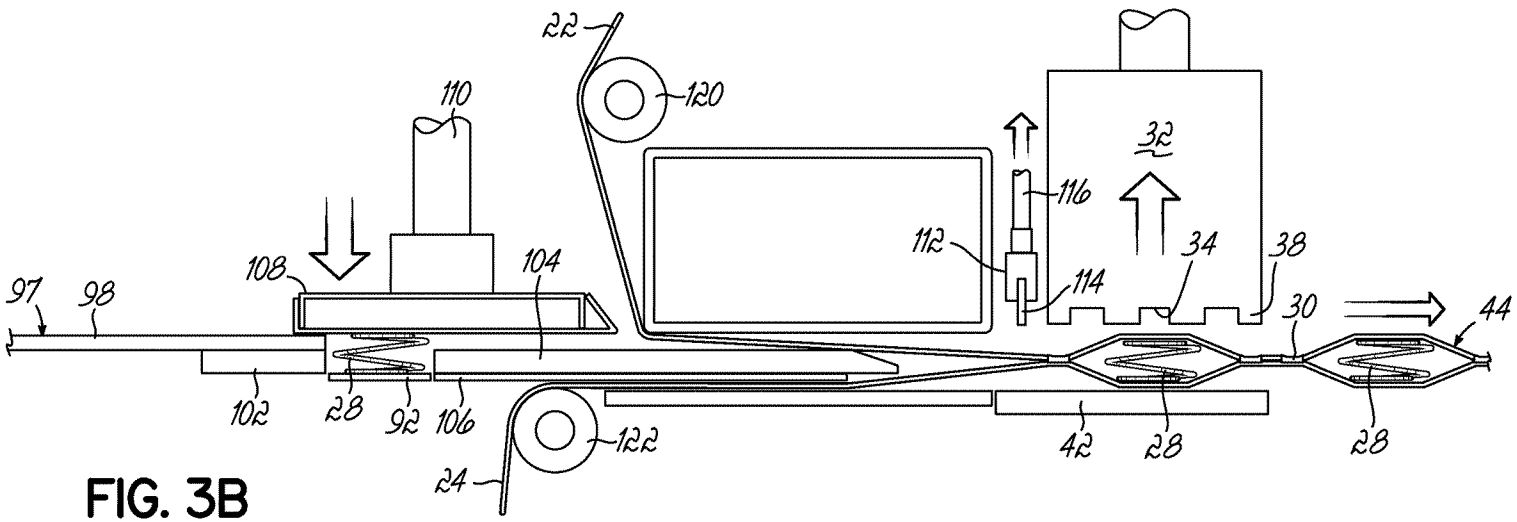
FIG. 3B is a cross-sectional view of the springs being compressed in the manufacturing process using the machine of FIGS. 2 and 2A.
Figure 3C:
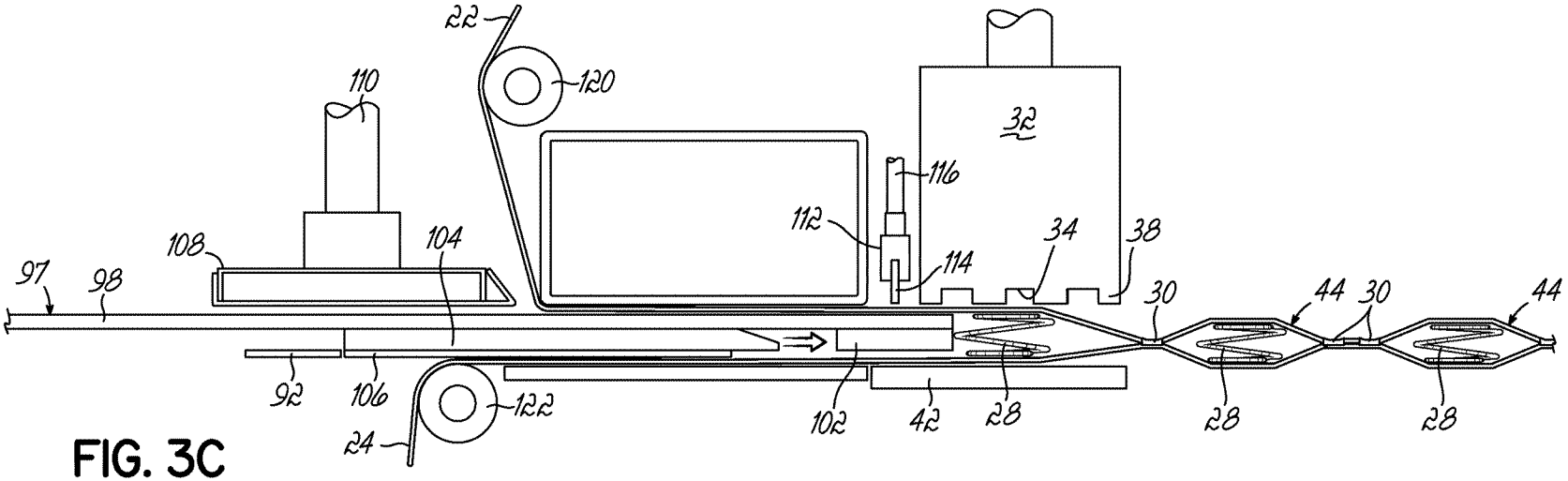
FIG. 3C is a cross-sectional view of the springs being laterally moved in the manufacturing process using the machine of FIGS. 2 and 2A.
Figure 3D:
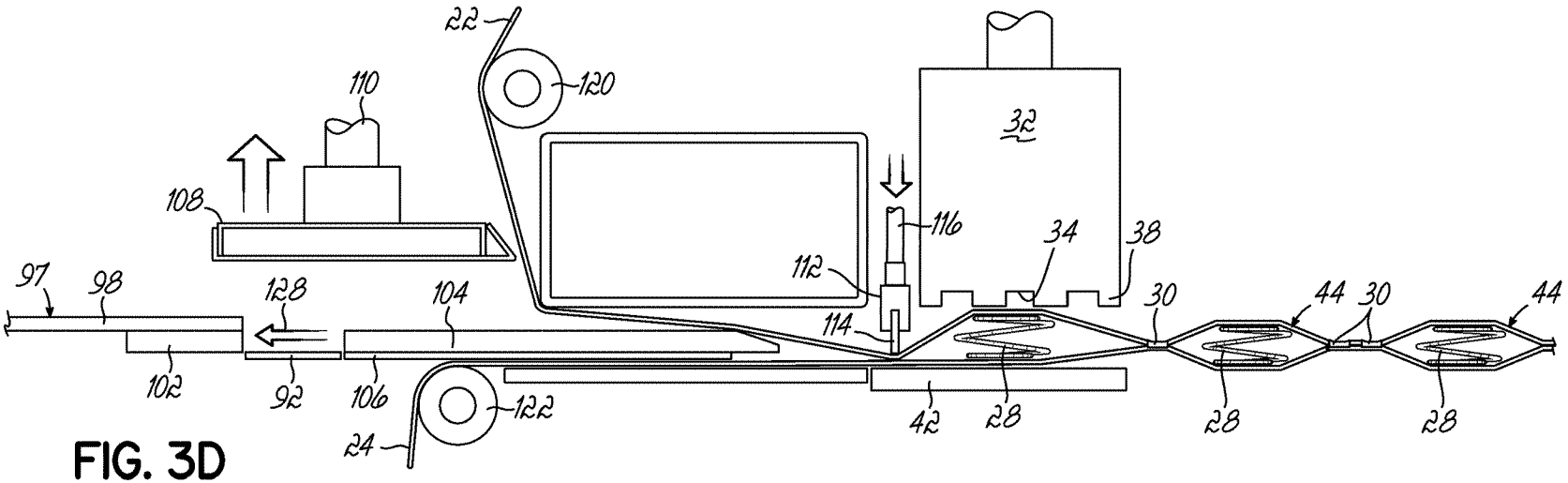
FIG. 3D is a cross-sectional view of the upper ply of fabric being moved in the manufacturing process using the machine of FIGS. 2 and 2A.
Figure 3E:
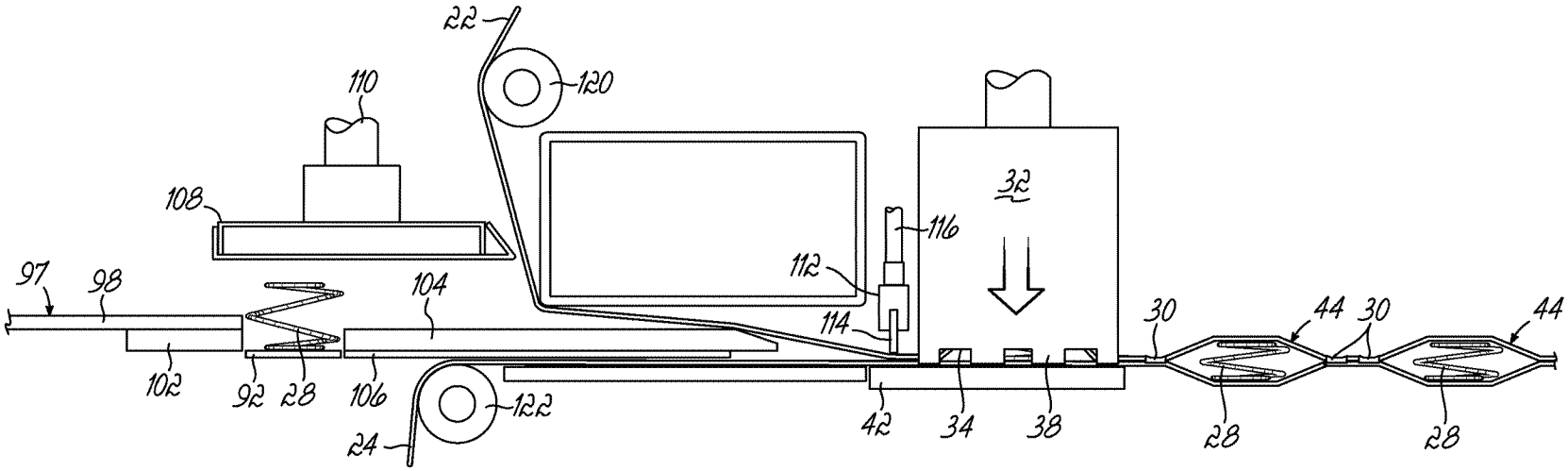
FIG. 3E is a cross-sectional view of one of the springs being sealed in the manufacturing process using the machine of FIGS. 2 and 2A.

As best shown in FIG. 2, machine 90 further comprises three pressers 112 movable between raised and lowered positions via actuators 116. FIGS. 3B and 3C show one of the pressers 112 in a raised position, while FIGS. 3A, 3D and 3E show the presser in a lowered position. Each presser has a blade 114 at the bottom thereof for bringing the plies 22, 24 of fabric together when the presser is lowered, as shown in FIGS. 3A, 3D and 3E.

As best shown in FIG. 3A, machine 90 further comprises rollers 120, 122 around which the plies, 22, 24, respectively, pass before they come together. After the circular seams 30 are created by the ultrasonic welding horn 32 and anvil 42, thereby creating the pockets 44, a main roller 116 and secondary roller 118 pull the continuous spring blanket 124 downwardly. Once a desired amount of continuous spring blanket 124 is made, a blade 126 cuts the continuous spring blanket 120 to create comfort layer 16 of the desired size. Of course, the machine 90 may be programmed to create the desired length and width of comfort layer. This machine 90 is adapted to make any of the comfort layers shown or disclosed herein having circular weld seams.

FIG. 3A illustrates the ultrasonic welding horn 32 in a lowered position contacting the stationary anvil 42 with at least one of the pressers 112 in a lowered position pressing the upper ply 22 into contact with the lower ply 24. A new row of mini coil springs 28 has been moved into a loading position with the compression plate 108 in its raised position.

FIG. 3B illustrates the ultrasonic welding horn 32 in a raised position spaced from the anvil 42 with at least one of the pressers 112 in a raised position. The compression plate 108 is moved to its lowered position by lifters 110, thereby compressing the row of mini coil springs 28 located on the conveyor 92.

FIG. 3C illustrates the row of compressed mini coil springs 28 located on the conveyor 92 being pushed downstream towards the ultrasonic welding horn 32 and stationary anvil 42 by the pusher assembly 97. More particularly, the pushers 102 secured to the pusher plate 98 contact the compressed mini coil springs 28 and move them downstream between the stationary guides 104 and past the raised pressers 112.

FIG. 3D illustrates the pusher assembly 97 being withdrawn in the direction of arrow 128. Additionally, the pressers 112 are moved to a lowered position, pressing the upper ply 22 into contact with the lower ply 24. Also, the compression plate 108 is moved to its raised position by lifters 110.

FIG. 3E illustrates the ultrasonic welding horn 32 in a lowered position contacting the stationary anvil 42 with at least one of the pressers 112 in a lowered position pressing the upper ply 22 into contact with the lower ply 24. A new row of mini coil springs 28 has been moved by the conveyor 92 into a position in which they may be compressed with the compression plate 108 during the next cycle.

Figure 8:
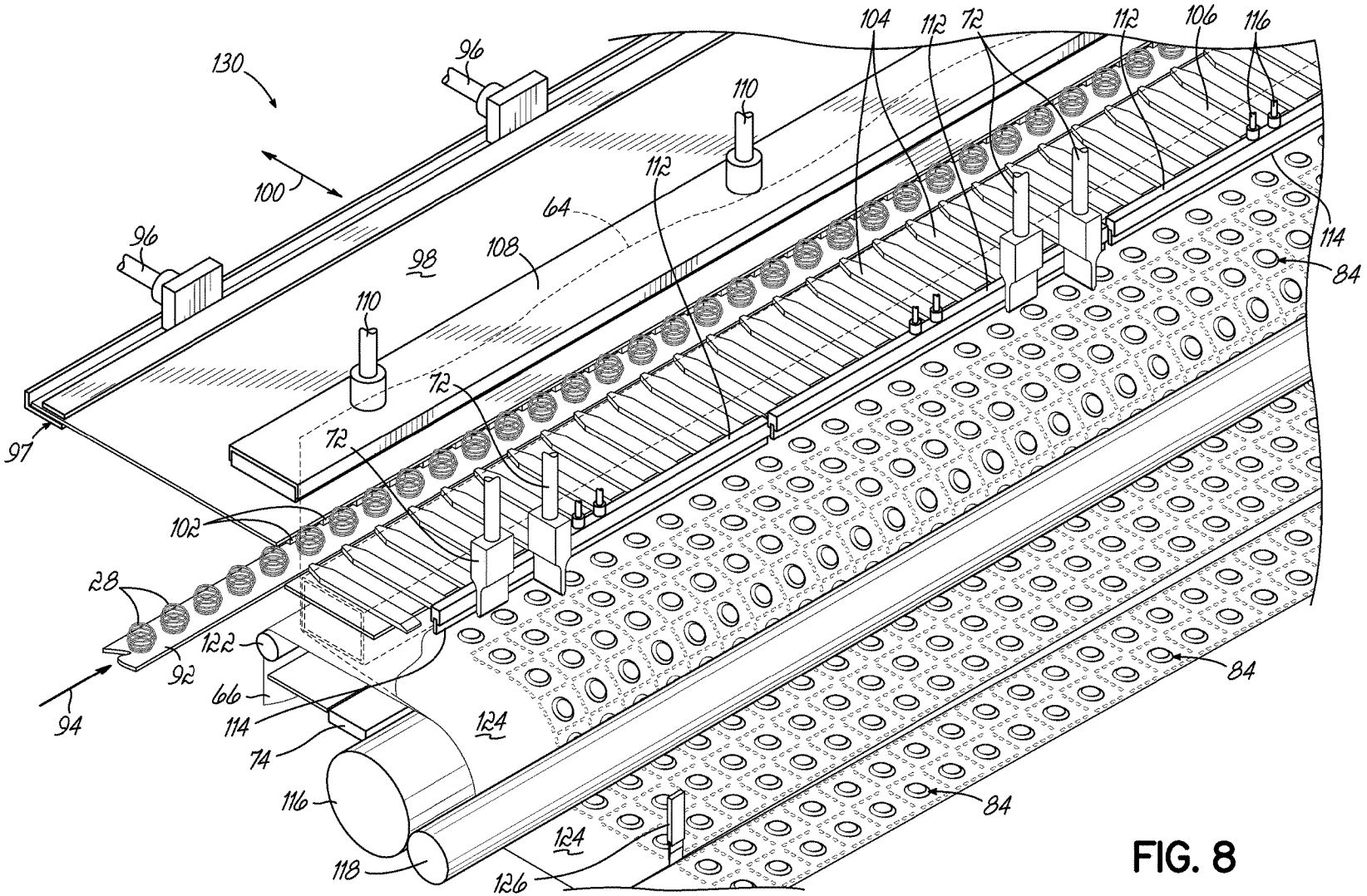
FIG. 8 is a perspective view of the comfort layer of FIG. 7 being manufactured.

FIG. 8 illustrates a machine 130, like the machine 90 shown in FIGS. 2 and 2A. However, instead of having two ultrasonic welding horns 32, machine 130 has four ultrasonic welding horns 72 along with anvil 74. Alternatively, ultrasonic welding horns 72*a* and anvil 74*a* of FIG. 9A may be used in machine 130. This machine 124 is adapted to make any of the comfort layers shown or disclosed herein having intersecting linear weld seams, as opposed to circular weld seams.

Figure 13A:
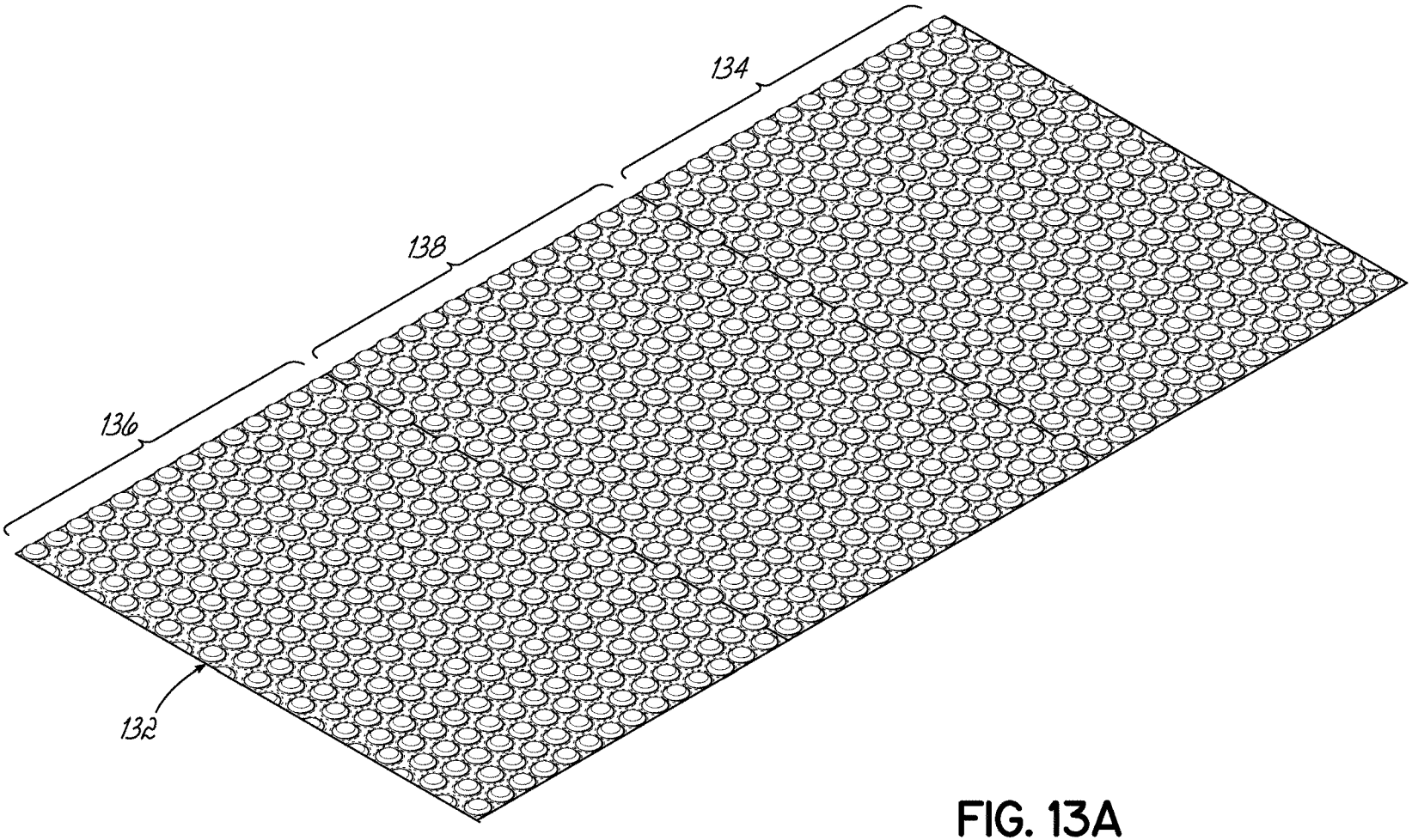
FIG. 13A is a perspective view of a posturized comfort layer.

FIG. 13A illustrates a posturized comfort layer 132 having three different areas or regions of firmness depending upon the airflow within each of the areas or regions. The comfort layer 132 has a head section 134, a foot section 136 and a lumbar or middle section 138 therebetween. The size and number of segments in the seams, along with the type of material used to construct the posturized comfort layer 132, may be selected so at least two of the sections may have a different firmness due to different airflows within different sections. Although three sections are illustrated in FIG. 13A, any number of sections may be incorporated into a posturized comfort layer. Although each of the sections is illustrated being a certain size, they may be other sizes. The drawings are not intended to be limiting. Although FIG. 13A shows each of the segmented weld seams of comfort layer 132 being circular, a posturized comfort layer, such as the one shown in FIG. 13A, may have intersecting linear weld seams.

Figure 13B:
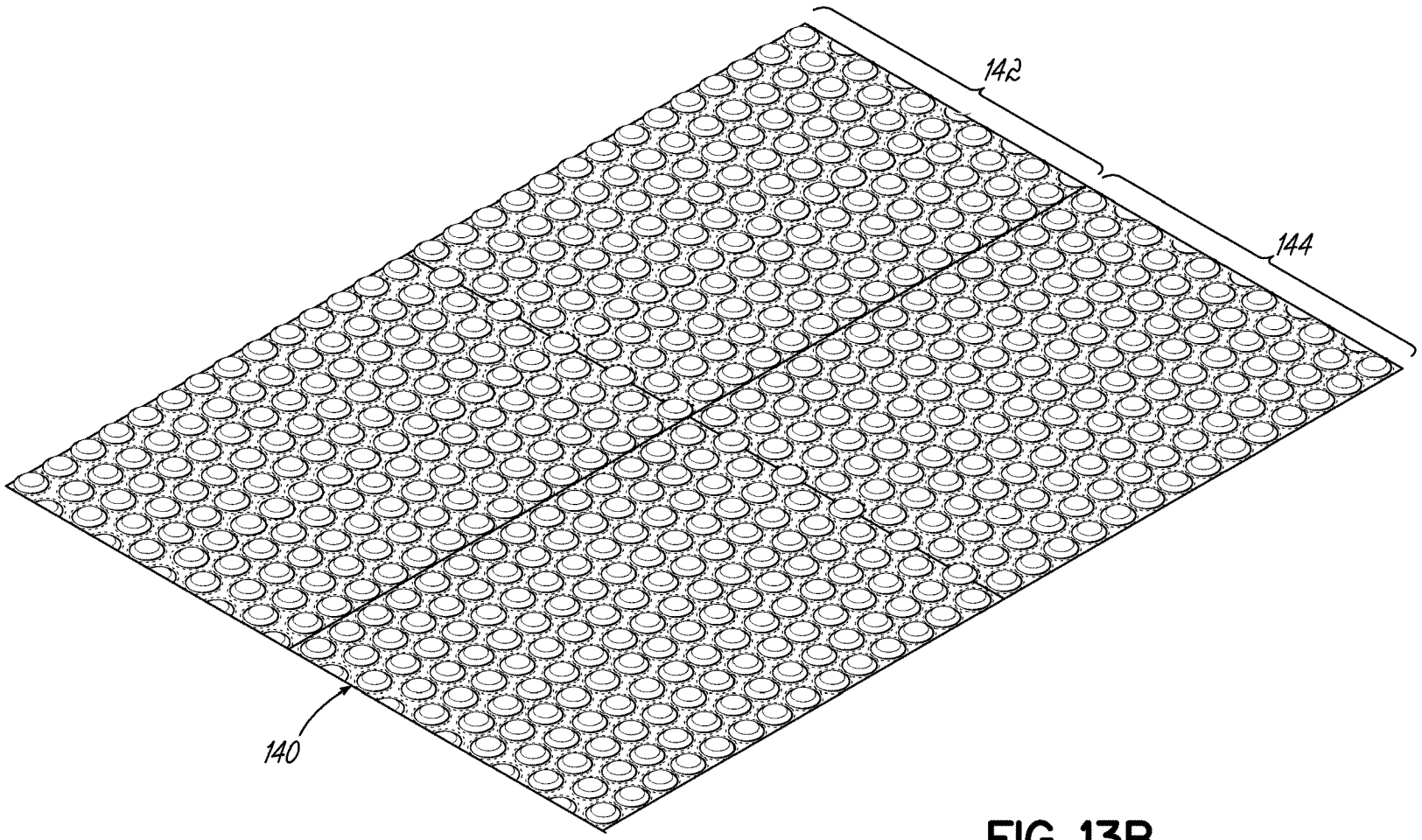
FIG. 13B is a perspective view of another posturized comfort layer.

FIG. 13B illustrates a posturized comfort layer 140 having two different areas or regions of firmness depending upon the airflow within each of the areas or regions. The comfort layer 140 has a first section 142 and a second section 144. The size and number of segments in the seams, along with the type of material used to construct the posturized comfort layer 140, may be selected so at least two of the sections may have a different firmness due to different airflows within different sections. Although two sections are illustrated in FIG. 13B, any number of sections may be incorporated into a posturized comfort layer. Although each of the sections is illustrated being a certain size, they may be other sizes. The drawings are not intended to be limiting. Although FIG. 13B shows each of the segmented seams of comfort layer 140 being circular, a posturized comfort layer, such as the one shown in FIG. 13B, may have intersecting linear weld seams.

Figure 14:
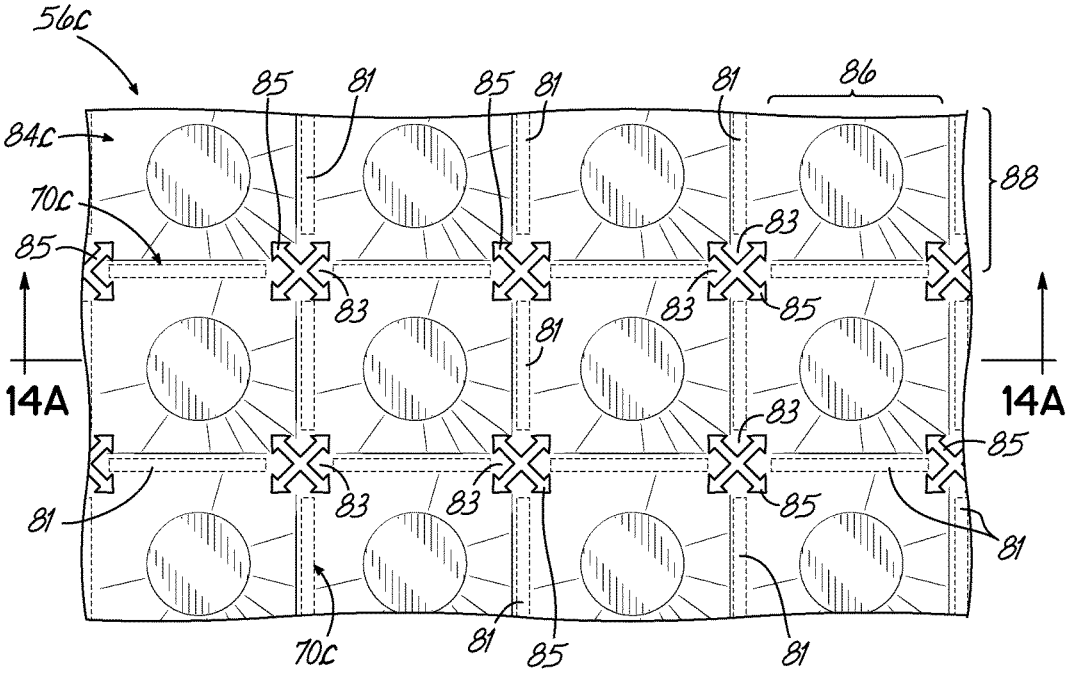
FIG. 14 is a top view of a portion of another embodiment of comfort layer.

FIG. 14 illustrates a portion of an alternative embodiment of comfort layer 56*c*. In this embodiment, the fabric of each of the first and second plies 65, 67 may be the same three-layered fabric impermeable to airflow shown in FIGS. 5B and 10B and described above. However, any of the fabrics described herein may be used in this embodiment.

Figure 14A:
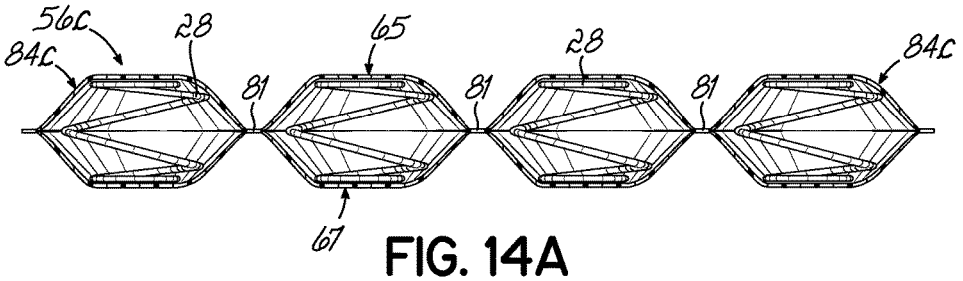
FIG. 14A is a cross-sectional view taken along the line 14A-14A of FIG. 14.
Figure 14B:
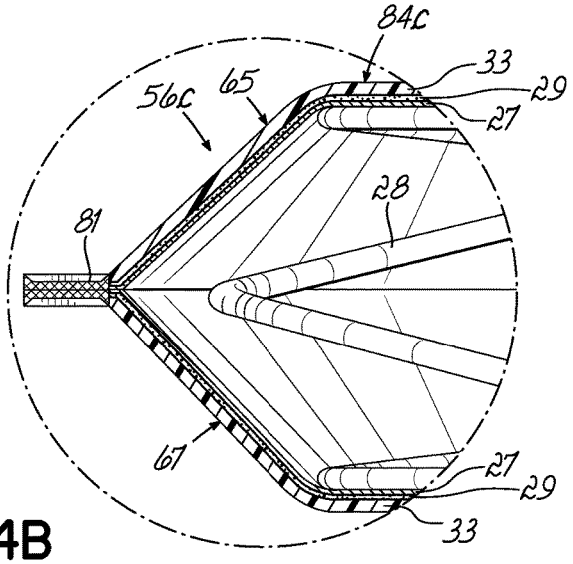
FIG. 14B is an enlarged cross-sectional view of an alternative embodiment having a different fabric.

As best illustrated in FIG. 14, the individual pockets 84*c* of comfort layer 56*c* may be arranged in longitudinally extending columns 86 extending from head-to-foot of the bedding product and transversely extending rows 88 extending from side-to-side of the bedding product. As shown in FIGS. 14 and 14A, the individual pockets 84*c* of one column 86 are aligned with the pockets 84*c* of the adjacent columns 86.

Air flows between pockets 84*c* and into and out of the comfort layer 56*c* through gaps 83 between linear segments 81 of weld seams 70*c*. The segments 81 of weld seams 70*c* are longer than other segments of other weld seams shown herein. One purpose of the longer segments 81 of weld seams 70*c* is so that air flows between pockets 84*c* at the corners of the pockets 84*c*, as depicted by arrows 85. The segments 81 of weld seams 70*c* join the first and second plies 65, 67 of fabric so air does not flow therebetween. Thus, air flows between air flows between pockets 84*c* only at the corners of the pockets 84*c*, as depicted by arrows 85. The desired amount of air flow between pockets 84*c* may be achieved by designing the gaps 83 between segments 81 of weld seams 70*c* to a desired size.

FIGS. 15, 15A, 15B and 15C illustrate another aspect of the present invention which is present along each of the weld seams shown or described herein regardless of the size and shape of the weld seam and regardless of the size and shape of the segments of the weld seam.

Figure 15:
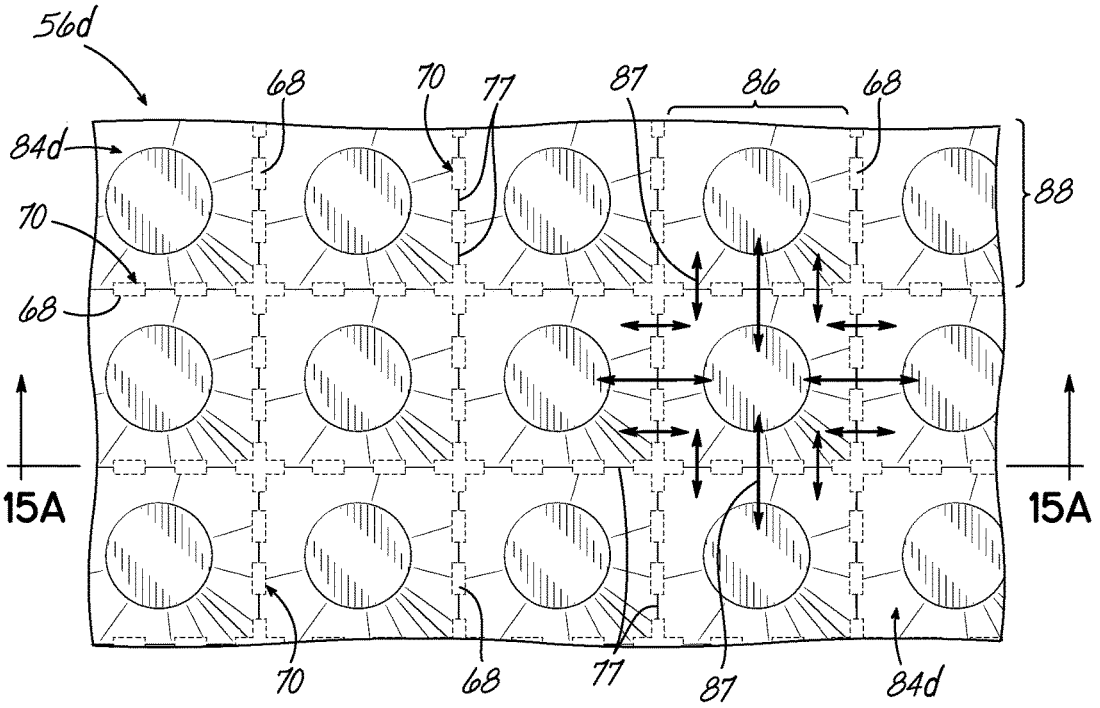
FIG. 15 is a top view of a portion of another embodiment of comfort layer.

This aspect of the invention is illustrated with regards to a comfort layer 56*d*, a portion of which is shown in FIG. 15. In this embodiment, the fabric of each of the first and second plies 89, 91 may be the same three-layered fabric impermeable to airflow shown in FIGS. 5B and 10B and described above. However, any of the fabrics described herein may be used in this embodiment.

As best illustrated in FIG. 15, the individual pockets 84*d* of comfort layer 56*d* may be arranged in longitudinally extending columns 86 extending from head-to-foot of the bedding product and transversely extending rows 88 extending from side-to-side of the bedding product. As shown in FIG. 15, the individual pockets 84*d* of one column 86 are aligned with the pockets 84*d* of the adjacent columns 86. Likewise, the individual pockets 84*d* of one row 88 are aligned with the pockets 84*d* of the adjacent rows 88.

Figure 15A:
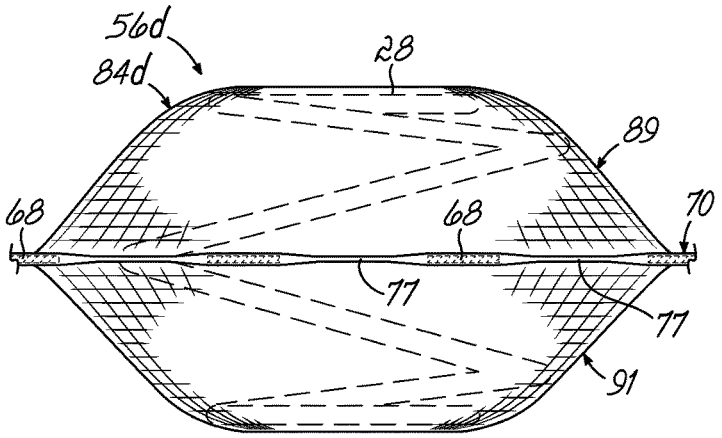
FIG. 15A is a detailed cross-sectional view taken along a portion of the line 15A-15A of FIG. 15.
Figure 15B:
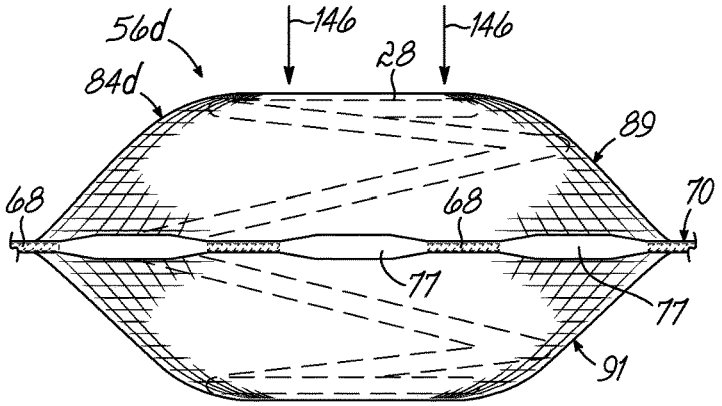
FIG. 15B is a detailed cross-sectional view of the pocketed spring of FIG. 15A under a load.
Figure 15C:
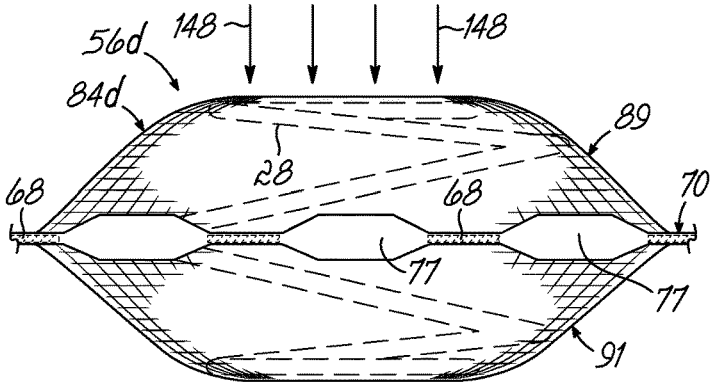
FIG. 15C is a detailed cross-sectional view of the pocketed spring of FIG. 15B under additional load.

As shown in FIGS. 15A, 15B and 15C, comfort layer 56*d* comprises two plies of fabric 89, 91 joined along linear segments 68 of intersecting linear weld seams 70, thereby creating pockets 84*d*, at least one spring 28 being in each pocket 84*d*. Air flows through pockets 84*d* through gaps 77 between linear weld segments 68, as illustrated by the arrows 87 of FIG. 15. The airflows affect the feel/compression of the individually pocketed mini coil springs 28 when a user lays on a mattress or seating product having at least one comfort layer 56*d*, as described above.

In this embodiment, the fabric of each of the first and second plies 89, 91 may be the same three-layered fabric impermeable to airflow shown in FIGS. 5B and 10B and described above. However, any of the fabrics described herein may be used in this embodiment.

For purposes of this document, the gaps 77 of weld seams 70 of comfort layer 56*d* may be considered valves which change in size depending on the load placed upon the pockets 84*d* of comfort layer 56*d* or removed from the pockets 84*d* of comfort layer 56*d* to control air flow as described below. Gaps 77 of the weld seams 70 function as valves in controlling the air flow into and out of the pockets 84*d* of the comfort layer 56*d* without any material or apparatus other than the multi-layered fabric of the plies 89, 91 of comfort layer 56*d*. The construction of the comfort layer 56*d* has inherent valves therein between seam segments, the valves controlling air flow into and out of the pockets 84*d* of the comfort layer 56*d* depending upon the size of the gaps and seam segments, the load(s) placed on the comfort layer 56*d* and the composition of the fabric material of the plies 89, 91 of comfort layer 56*d*, among other factors.

FIG. 15A shows one pocket 84*d* of the comfort layer 56*d* without any load placed on the pocket 84*d*. The pocket 84*d* is in a relaxed condition. Air is not flowing through the gaps 77 of the weld seams 70 of pocket 84*d*. The air pressure inside the pockets 84*d* is at atmospheric pressure at ambient temperature so the valves 77 are in a relatively restrictive state, i.e. relatively flat. The opposed plies 89, 91 of fabric of the gaps 77 of weld seams 70 may be contacting each other or very close to each other. See FIG. 15A.

FIG. 15B shows the pocket 84*d* with a light load placed on the pocket 84*d*, as indicated by arrows 146. Once a light load is placed on the pocket 84*d*, at least some of the valves or gaps 77 of the weld seams 70 surrounding the pocket 84*d* open slightly so that air flows through at least some of the gaps 77 of the weld seams 70 of pocket 84*d*.

FIG. 15C shows the pocket 84*d* with a heavier load placed on the pocket 84*d*, as indicated by the four arrows 148. Once a larger or greater load is placed on the pocket 84*d*, at least some of the valves or gaps 77 of the weld seams 70 open even more so that more air flows through at least some of the gaps 77 of the weld seams 70 of pocket 84*d*. For purposes of this document, the term "open" means increasing in width. Therefore, when a valve or gap 77 opens it increases in width.

If a load is applied to the pocket 84*d* that is significantly greater than the load needed to open the valves 77 of the weld seams 70, the fabric material of the pocket 84*d* will elastically stretch and open further to allow more air to pass through the valves or gaps in the weld seams. Thereby, the valves react to the specific load applied. Such reaction contributes to the unique luxurious feel of a comfort layer made in accordance with the present invention.

In the event, the plies are made of the multi-layered fabric disclosed herein, the ability of the valves to stretch and react to the air pressure is largely due to the middle thermoplastic polyurethane film layer. The middle thermoplastic polyurethane film layer is a relatively elastic material which returns to its original shape after a load is removed. When the load is released, the valves return to their original condition which is a relatively restrictive state in which the air pressure inside the pockets is at atmospheric pressure at ambient temperature.

While I have described several preferred embodiments of this invention, persons skilled in this art will appreciate that other semi-impermeable and non-permeable fabric materials may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, I do not intend to be limited except by the scope of the following appended claims.

I claim:

1. A method of manufacturing a comfort layer for a bedding or seating product, which comfort layer is characterized by slow and gentle compression when a load is applied to the product, the method comprising:

forming a continuous blanket of individually pocketed mini coil springs, each of the individually pocketed mini coil springs containing a mini coil spring contained within an individual pocket of fabric, the individual pocket being formed by joining multiple pieces of fabric with intersecting linear weld seams surrounding one of the mini coil springs, each of the pieces of fabric being impermeable to airflow through the fabric, the opposed pieces of fabric being joined along linear weld segments with gaps between adjacent linear weld segments; and cutting the continuous blanket of individual pocketed mini coil springs to a desired size to create a comfort layer, the comfort layer being characterized, when a load is placed upon the comfort layer, by the rate of deflection of the comfort layer being retarded by the rate at which air passes through the gaps of the linear weld seams without passing through the pieces of fabric, the gaps widening upon being subjected to the load, allowing air to exit the pockets of the comfort layer at a desired rate.

2. The method of claim 1, wherein the comfort layer is further characterized by the rate of recovery of the comfort layer to its original height after removal of the load from the comfort layer being retarded by the rate at which air returns between the segments of the weld seams into the pockets, the gaps decreasing in width upon the load being removed, allowing air to enter the pockets of the comfort layer at a desired rate only through the gaps.

3. The method of claim 1, wherein the weld seams are configured to allow air to pass through the gaps between the segments of the weld seams at a desired rate.

4. The method of claim 1, wherein the fabric is a three layer fabric.

5. A method of manufacturing a comfort layer for a bedding or seating product, which comfort layer is characterized by slow and gentle compression when a load is applied to the product, the method comprising:

forming a continuous blanket of individually pocketed mini coil springs, each of the individually pocketed mini coil springs comprising a mini coil spring contained within an individual pocket of fabric, the pocket of fabric being formed by joining multiple pieces of fabric with intersecting linear weld seams surrounding one of the mini coil springs, each of the pieces of fabric comprising multiple layers, at least one of the layers being impermeable to airflow, the opposed pieces of fabric being joined along linear weld segments to create individual pockets surrounding each mini coil spring with gaps between adjacent linear weld segments; and cutting the continuous blanket of individual pocketed mini coil springs to a desired size to create a comfort layer, the comfort layer being characterized, when a load is placed upon the comfort layer, by the rate of deflection of the comfort layer being retarded by the rate at which air passes through the gaps of the linear weld seams without passing through the pieces of fabric, the gaps widening upon being subjected to the load, allowing air to exit the pockets of the comfort layer at a desired rate only through the gaps.

6. The method of claim 5, wherein the comfort layer is further characterized by the rate of recovery of the comfort layer to its original height after removal of the load from the comfort layer being retarded by the rate at which air returns between the segments of the weld seams into the pockets, the gaps decreasing in width upon the load being removed, allowing air to enter the pockets of the comfort layer at a desired rate through the gaps only without passing through the pieces of fabric.

7. The method of claim 6, wherein the weld seams are configured to allow air to pass through the gaps between the segments of the weld seams at a desired rate.

8. A method of manufacturing a comfort layer for a bedding or seating product, which comfort layer is characterized by slow and gentle compression when a load is applied to the product, the method comprising:

forming a continuous blanket of individually pocketed mini coil springs, each of the individually pocketed mini coil springs comprising a mini coil spring being contained within an individual pocket of fabric, the pocket of fabric being formed by joining multiple pieces of fabric with intersecting linear weld seams surrounding one of the mini coil springs, each of the pieces of fabric comprising multiple layers, at least one of the layers being impermeable to airflow, the opposed pieces of fabric being joined along linear weld segments with gaps between adjacent linear weld segments; and cutting the continuous blanket of individual pocketed mini coil springs to a desired size to create a comfort layer, the comfort layer being characterized, when a load is placed upon the comfort layer, by the rate of deflection of the comfort layer being retarded by the rate at which air passes through the gaps of the linear weld seams without passing through the pieces of fabric, the gaps widening upon being subjected to the load, allowing air to exit the pockets of the comfort layer at a desired rate only through the gaps, wherein the heavier the load the wider the gaps.

9. The method of claim 8, wherein the comfort layer is further characterized by the rate of recovery of the comfort layer to its original height after removal of the load from the comfort layer being retarded by the rate at which air returns between the segments of the weld seams into the pockets, the gaps decreasing in width upon the load being removed, allowing air to enter the pockets of the comfort layer at a desired rate through the gaps only without passing through the pieces of fabric.

10. The method of claim 6, wherein the weld seams are configured to allow air to pass through the gaps between the segments of the weld seams at a desired rate.

* * * * *